US010794127B2

(12) United States Patent
Richardson

(10) Patent No.: US 10,794,127 B2
(45) Date of Patent: Oct. 6, 2020

(54) CONTINUOUS ROTATION MAKE/BREAK MACHINE

(71) Applicant: WARRIOR RIG TECHNOLOGIES LIMITED, Calgary (CA)

(72) Inventor: Allan Stewart Richardson, The Woodlands, TX (US)

(73) Assignee: Warrior Rig Technologies Limited, Calgary (CA)

( * ) Notice: Subject to any disclaimer, the term of this patent is extended or adjusted under 35 U.S.C. 154(b) by 188 days.

(21) Appl. No.: 16/064,392

(22) PCT Filed: Jan. 25, 2017

(86) PCT No.: PCT/CA2017/050077

§ 371 (c)(1),
(2) Date: Jun. 20, 2018

(87) PCT Pub. No.: WO2017/127924

PCT Pub. Date: Aug. 3, 2017

(65) Prior Publication Data

US 2019/0024466 A1 Jan. 24, 2019

Related U.S. Application Data

(60) Provisional application No. 62/286,904, filed on Jan. 25, 2016.

(51) Int. Cl.
*E21B 19/16* (2006.01)

(52) U.S. Cl.
CPC ..... *E21B 19/164* (2013.01)

(58) Field of Classification Search
CPC ..... E21B 19/16; E21B 19/164; E21B 19/163
See application file for complete search history.

(56) References Cited

U.S. PATENT DOCUMENTS 2,650,070 A * 8/1953 Lundeen ..... E21B 19/164 81/57.18
2,879,680 A * 3/1959 Beeman ..... E21B 19/164 81/57.18
2,989,880 A * 6/1961 Hesser ..... E21B 19/164 81/57.18
4,334,444 A 6/1982 Carstensen et al.
4,474,088 A * 10/1984 Lee ..... E21B 19/16 81/57.18
6,829,967 B1 12/2004 Kemp
8,096,528 B2 1/2012 Weingartner et al.
8,109,179 B2 2/2012 Richardson
8,863,621 B2 10/2014 Richardson
8,939,048 B2 1/2015 Holen
9,017,194 B2 * 4/2015 Richardson ..... F16H 7/02 474/86
9,297,223 B2 3/2016 Richardson
(Continued)

*Primary Examiner* — David B. Thomas
(74) *Attorney, Agent, or Firm* — Oyen Wiggs Green & Mutala LLP

(57) ABSTRACT

A rotor carries a gripping mechanism operable to grip an elongated object such as a drill string section. The rotor is driven by one or more drive mechanisms comprising a flexible element such as a chain. The flexible element allows some relative motion of the rotor and the drive mechanism. The described apparatus has application in making and breaking connections between tubulars in subsurface drilling operations.

50 Claims, 20 Drawing Sheets

(56) References Cited

U.S. PATENT DOCUMENTS

| | | | |
|---|---|---|---|
| 9,528,332 | B2 | 12/2016 | Richardson |
| 2006/0174729 | A1 | 8/2006 | Slettedal et al. |
| 2013/0090200 | A1 | 4/2013 | Richardson |
| 2014/0305265 | A1 | 10/2014 | Haughom |
| 2015/0315858 | A1 | 11/2015 | Gaskin et al. |

* cited by examiner

CONTINUOUS ROTATION MAKE/BREAK MACHINE

CROSS-REFERENCE TO RELATED APPLICATIONS

This application claims priority from U.S. Application No. 62/286,904 filed 25 Jan. 2016. For purposes of the United States, this application claims the benefit under 35 U.S.C. § 119 of U.S. Application No. 62/286,904 filed 25 Jan. 2016 and entitled CONTINUOUS ROTATION MAKE/BREAK MACHINE which is hereby incorporated herein by reference for all purposes.

TECHNICAL FIELD

This invention relates to apparatus and related methods useful for gripping and rotating objects. An example application of the present technology is rotating tubular drill string sections (drill pipe, drill collar, drilling tools, or sections of casing) to make or break threaded connections between such sections. Another example application is to rotate oilfield tubulars for drilling or running casing into a wellbore. Example embodiments permit continuous rotation of objects.

BACKGROUND

Subsurface drilling uses a drill string made up of a series of sections that are connected to one another end-to-end. The sections that couple together longitudinally to make a drill string may be called "drill string sections", "joints", "tubulars", "drill pipes", or "drill collars". Most commonly, the sections each have a pin end (male end) and a box end (female end) with complementary threads that are screwed together. The threads are commonly API standard threads.

When a well is being drilled, a drill bit is provided at the downhole end of the drill string. The drill bit drills a borehole that is somewhat larger in diameter than the drill string such that there is an annulus surrounding the drill string in the borehole. As the well is drilled, drilling fluid is pumped down through the drill string to the drill bit where it exits and returns to the surface through the annulus. The drilling fluid serves to counteract downhole pressures and keep the wellbore open. The drilling fluid also carries rock and other cuttings to the surface. As drilling progresses and the well bore gets deeper, new drill string sections are added at the uphole end of the drill string. Each of these new drill string sections must be firmly coupled to the drill string. Typically, a coupling between commonly-used 5-inch diameter drill string sections is made up using a torque of 35,000 foot-pounds (about 47,500 N·m) or more. The torque required in any particular case depends on the size of the drill string sections and the thread geometry.

Adding a new section typically involves supporting the drill string, uncoupling the top end of the drill string from the kelly or top drive that was supporting it, coupling a new section to the top end of the drill string, connecting the uphole end of the new section to the kelly or top drive and resuming drilling. Typically the weight of the drill string is carried by slips on the drill rig floor while a new section is being added to the drill string.

Making up a connection between two tubulars involves rotating the tubulars relative to one another. Example apparatus capable of performing this function is described in U.S. Pat. Nos. 8,109,179 and 8,863,621 which are hereby incorporated herein by reference.

Making up a threaded connection between two tubulars may require that the tubulars be turned through multiple complete revolutions relative to one another. It is common to provide a wrench that combines a spinner that is capable of rotating a tubular rapidly at low torque with a wrench/gripper that can tighten the tubular to the required torque. The wrench/gripper typically has a limited angular movement. It is often necessary to apply the wrench/gripper several times to achieve a desired torque. Such wrenches may suffer from inconsistency and may be slower than desired especially in cases where the gripper needs release and re-grip the tubular one or more times before the desired torque has been achieved. Such wrenches can be very inefficient for coupling sections of casing because casing often requires a relatively large number of turns at torques higher than can be achieved by a typical spinner in order to make up joints between sections of casing.

There is a need for apparatus which is cost effective and durable and which is capable of continuously or discretely gripping and rotating an elongated object such as a tubular for use in subsurface drilling or other applications. There is a particular need for such apparatus which is capable of receiving tubulars in a transverse direction (i.e. by moving the tubular sideways relative to a longitudinal axis of the tubular).

The foregoing examples of the related art and limitations related thereto are intended to be illustrative and not exclusive. Other limitations of the related art will become apparent to those of skill in the art upon a reading of the specification and a study of the drawings.

SUMMARY

This invention has a number of aspects. One aspect provides apparatus for rotating oilfield tubulars or other elongated objects. The apparatus is configured to receive a tubular in a direction that is sideways to a longitudinal axis of the tubular. Another aspect provides methods for rotating oilfield tubulars or other elongated objects using apparatus as described herein.

One example aspect of the invention provides apparatus useful for rotating a section of drill pipe or casing or another elongated object. The apparatus comprises a rotor configured with a gap extending from a periphery of the rotor to a central region of the rotor. While other configurations are possible, in some embodiments the rotor is generally circular in plan view and the gap extends inwardly from the periphery of the rotor. Such a rotor may be called C-shaped.

A gripping mechanism comprising one or more jaws is carried by the rotor. One or more grip actuators is operable to move the jaws between an engaged configuration wherein the jaws grip an elongated object in the central region and a disengaged configuration wherein the jaws permit passage of the elongated object through the gap. The grip actuators may be carried by the rotor and may, for example, be hydraulic actuators. In other embodiments the grip actuators are mounted off of the rotor and are operable to engage and disengaged the jaws from an oilfield tubular or other elongated member.

A drive mechanism comprising a closed loop drive member having driving elements spaced apart along the drive member by a pitch distance; a portion of the drive member wrapped around a corresponding part of the periphery of a drive ring on the rotor, the drive ring including drive features configured to be engaged by the driving elements of the drive member and spaced apart from one another by the pitch distance on a portion of the drive ring extending from a first point on a first side of the gap to a second point on a second side of the gap, wherein the gap and drive ring are dimensioned such that the distance between the first point and the second point is an integer multiple of the pitch distance both when measured along a path taken by the drive member across the gap and along a path extending along the portion of the drive ring.

The drive mechanism may, for example, comprise first and second rollers spaced apart from one another around a circumference of the rotor. With the rollers positioned such that the drive member is flexed to provide a concave portion that contacts the rotor between the rollers. The rollers may be spaced far enough apart from the rotor to allow the rotor to be displaced radially while the drive member.

The drive mechanism may comprise a tensioner comprising an actuator operable to tension the drive member. The tensioner may accommodate changes in the path length of the rotor as the rotor turns and/or is displaced radially. In some embodiments the actuator is coupled to move at least one of the first and second rollers. For example, the tensioner may comprise a cam operated by the actuator and configured to move one of the first and second rollers. In some embodiments the tensioner comprises a spring. The actuator may be connected to operate in parallel with the spring. For example, the spring may apply a certain base level of tension to the drive member and the actuator may be operable to increase the tension above the base level.

In some embodiments the actuator comprises a hydraulic actuator connected to a source of pressurized fluid. The source of pressurized fluid may have a variable pressure that increases with increased torque on the rotor and/or a variable pressure that depends on a direction of circulation of the drive member. For example, the source of pressurized fluid may comprise an input line to a hydraulic motor driving the rotor.

In some embodiments the apparatus includes plural drive mechanisms. The plural drive mechanisms may be the same as one another or different. In some embodiments the plural drive mechanisms are spaced around the rotor and arranged such that radial forces exerted on the rotor by each of the drive mechanisms substantially cancel out. For example, first and second drive mechanisms may be diametrically opposed to one another on opposite sides of the rotor. Radial forces exerted on the rotor by each of the two drive mechanisms oppose one another.

The rotor may be supported for rotation by a compliant mounting. The compliant mounting may permit significant radial displacement of the rotor relative to a neutral position. For example, the compliant mounting may permit the rotor to rotate while a center of rotation of the rotor is located anywhere within a 12 mm diameter circle that is fixed relative to the frame. In an example embodiment the rotor is supported by a plurality of spring-loaded rollers or slides spaced apart around a periphery of the rotor. In such embodiments the spring-loaded rollers or slides may be carried on a frame and engage a feature of the rotor or may be carried on the rotor and engage a feature supported on a frame. For example the spring-loaded rollers may engage a flange carried by the rotor and thereby provide axial support to the rotor. The flange is interrupted at the location of the gap. The flange may comprise amped portions at either side of the gap.

Power may be provided on the rotor for operating the gripper or for other uses. In some embodiments the power is generated by one or more generators carried by the rotor. Such generators may be driven by a serpentine member such as a belt arranged to follow a path having a portion wherein the serpentine belt engages sprockets carried on the rotor and located outside of a loop made by the path of the serpentine belt. The sprockets may be connected to drive the one or more generators. The sprockets may comprise suitable rollers which may optionally have teeth or other features to engage the serpentine member. The sprockets may comprise suitable sheaves, pulleys, gears, toothed sprockets, or the like.

Some embodiments include an umbilical connected to deliver power to the rotor. The umbilical may optionally connect to the rotor at a rotatable coupling. The umbilical may be stored on a spring-loaded reel, a festoon, a hanging loop or the like. In some embodiments the umbilical has a length of at least 4 to 6 times a circumference of the rotor at a location where the umbilical wraps around the rotor. A control system may automatically stop rotation of the rotor before a predetermined length of the umbilical has been wrapped around the rotor (i.e. after a predetermined number of rotations of the rotor).

The drive member may take a variety of forms. In some embodiments the drive member comprises a chain such as a roller chain or link chain or toothed chain. In some embodiments the drive member comprises a toothed belt. Inner and outer faces of the belt are toothed in some embodiments.

Another aspect of the invention provides apparatus useful for rotating oilfield tubulars. The apparatus may optionally comprise any of the features or feature combinations described above. The apparatus comprises a rotor mounted to a frame configured with an opening on at least one side of the rotor. The rotor comprises a gap extending from a periphery of the rotor to a central region of the rotor through which a central axis of the rotor passes. The rotor is mounted to the frame by way of a compliant mounting that permits rotation of the rotor relative to the frame and displacements of the rotor relative to the frame that are radial relative to the central axis of the rotor, the compliant mounting comprising resiliently biased sliders or rollers. A gripper is provided on the rotor. The gripper is arranged to grip a tubular located on or close to the central axis.

A compliant drive mechanism comprising a closed loop drive member is arranged to circulate around a first path wherein the rotor is on an outside of the first path and a portion of the drive member is wrapped around a corresponding part of the periphery of the rotor. A motor is connected to drive the drive member. A tensioner comprising an actuator is connected to tension the drive member.

Some embodiments further include a system for delivering power to the rotor. Such a system may include a closed loop serpentine member arranged to circulate around a second closed path wherein the rotor is outside of the second closed path. An outside of the serpentine member may engage plural sprockets carried by the rotor. The serpentine member may comprise a tensioner arranged to tension the serpentine member sufficiently to maintain contact of the serpentine member with one or more of the sprockets while accommodating the radial displacements of the rotor within a range permitted by the compliant mounting.

The drive member may have driving elements spaced apart along the drive member by a pitch distance. In such embodiments the rotor includes drive features configured to be engaged by the driving elements of the drive member and spaced apart from one another by the pitch distance on a portion of a drive ring extending from a first point on a first side of the gap to a second point on a second side of the gap. The gap and drive ring may be dimensioned such that the distance between the first point and the second point is an integer multiple of the pitch distance both when measured along a path taken by the drive member across the gap and along a path extending along the portion of the drive ring.

The drive mechanism may comprise first and second rollers spaced apart from one another around a circumference of the rotor wherein the rollers are positioned such that the drive member is flexed to provide a concave portion that contacts the rotor between the rollers. The actuator may be coupled to move at least one of the first and second rollers. For example, the apparatus may comprise a cam or other linkage operated by the actuator and configured to move one of the first and second rollers.

The compliant mounting may provide axial support to the rotor.

In addition to the exemplary aspects and embodiments described above, further aspects and embodiments will become apparent by reference to the drawings and by study of the following detailed descriptions.

Other aspects of the invention provide apparatus having any new and inventive feature, combination of features, or sub-combination of features as described herein.

Other aspects of the invention provide methods having any new and inventive steps, acts, combination of steps and/or acts or sub-combination of steps and/or acts as described herein.

BRIEF DESCRIPTION OF THE DRAWINGS

Example embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Apparatus according to some embodiments of this invention includes a rotor which has a gap or opening extending from a periphery of the rotor inwardly to a center of rotation of the rotor. The gap allows an elongated object such as a tubular to be moved laterally to the center of rotation of the rotor while the object remains oriented generally parallel to the axis of rotation of the rotor. The rotor includes a gripping mechanism arranged to grip and hold the elongated object. The drive is coupled to turn the rotor about its axis of rotation. In use, a tubular is brought to the center of rotation, either by moving the tubular laterally through the gap, moving the apparatus relative to the tubular, or both. With the tubular at the center of rotation, the gripping mechanism is actuated to grasp the tubular. The drive mechanism may then be operated to turn the rotor, thereby turning the tubular. A second tubular may be held by a backup jaw or other gripping mechanism so that the two tubulars are turned relative to one another to either make or break a threaded coupling between the tubulars.

Figure 1:
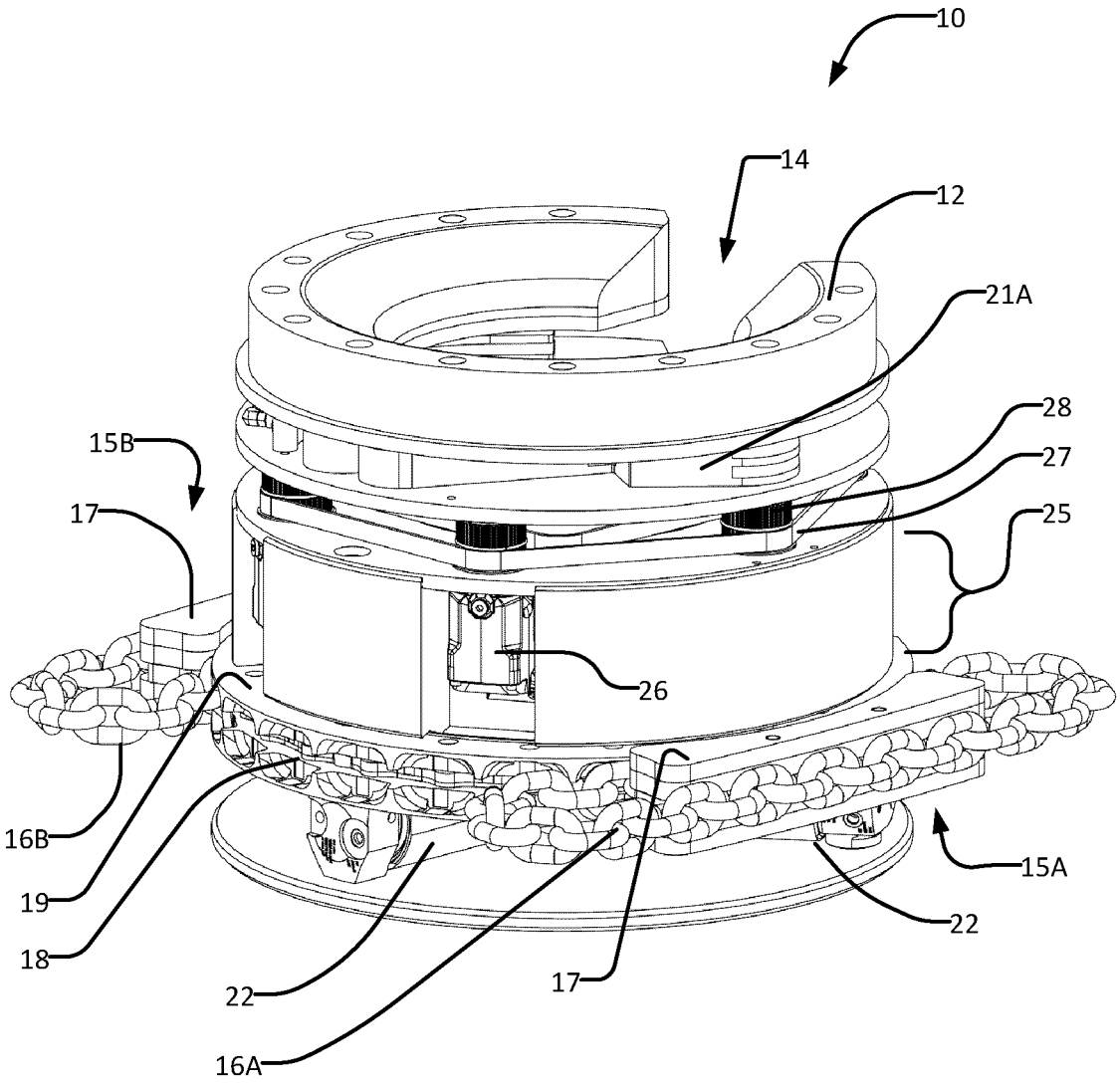
FIG. 1 is a perspective view of apparatus according to an example embodiment of the invention (with some parts not shown for clarity).

FIG. 1 shows apparatus 10 according to an example embodiment of the invention. Apparatus 10 includes a rotor 12 having a gap 14 (gap 14 may also be described as a slot or throat) that extends to an area surrounding a center of rotation of rotor 12. Gap 14 is dimensioned to allow the tubular to be brought to a position where the longitudinal axis of the tubular coincides at least approximately with the center of rotation of rotor 12.

For example in a case where apparatus 10 is designed to work with tubulars or other elongated cylindrical objects up to a certain maximum diameter gap 14 may be somewhat wider than the maximum diameter and gap 14 may be shaped so that the rotor is clear of a circle of the maximum diameter centered on the axis of rotor 12. In a non-limiting example embodiment gap 14 has a width of about 9¾ inches (about 25 cm) which is wide enough to accommodate tubulars ranging in diameter up to about 9⅝ inches (about 24½ cm). Such apparatus 10 may be used, for example, to make or break connections between sections of drill pipe and/or casing.

Rotor 12 is driven in rotation by one or more drive mechanisms 15. The illustrated embodiment has two drive mechanisms 15A and 15B (collectively or generally drive mechanisms 15). Although two drive mechanisms are shown, the number of drive mechanisms provided may be varied. Some embodiments may include only one drive mechanism 15. Other embodiments may have three or four drive mechanisms 15. Providing two drive mechanisms 15, as illustrated, which drive opposing sides of rotor 12 is beneficial because reaction forces imparted by drive mechanisms 15A and 15B on rotor 12 are approximately balanced. Drive mechanism(s) 15 are arranged so that, for at least one orientation of rotor 12, the drive mechanism(s) 15 do not obstruct access to gap 14.

In the embodiment shown in FIG. 1, drive mechanisms 15 are supported by a frame 11 configured with an opening 11A. Rotor 12 may be rotated so that gap 14 is generally aligned with opening 11A. A tubular may then be moved transversely into gap 14 through opening 11A. In another example embodiment (not shown) drive mechanism(s) 15 may be supported by a structure which provides openings 11A facing in two or more directions. For example, two openings 11A diametrically-opposed relative to rotor 12 may be provided. Constructions having two or more openings 11A facilitate bringing an elongated object into gap 14 of rotor 12 from one direction and removing the elongated object in another direction, receiving elongated objects from plural directions and/or dispatching elongated objections in plural directions.

In the illustrated embodiment, each drive mechanism 15 includes a flexible drive member 16. Drive members 16 include drive elements spaced apart by a pitch distance. In the illustrated embodiment drive member 16 comprises a drive chain. Drive chains 16A and 16B are shown and referred to collectively or generally as drive chains 16. Each of drive chains 16 passes around rollers (not shown in FIG. 1) such that each drive chain 16 can circulate around a closed path. The rollers are positioned and dimensioned such that engagement of rotor 12 with drive chains 16 causes drive chains 16 to flex so that their portions that contact rotor 12 are concave. Tension in each drive chain 16 therefore tends to urge the portions of drive chains 16 that contact rotor 12 to press against rotor 12. In the example embodiment, drive chains 16 each pass around two rollers 29 (see FIGS. 2A and 2B) that are dimensioned such that a line joining tangents of the rollers passes through rotor 12. More specifically a portion of a line joining tangents of the pitch circles of rollers 29 may pass inside the pitch circle of drive ring 19 of rotor 12.

In the illustrated embodiment, chains 16 comprise link chains made up of inter-connected links 16C. Such chains are sometimes called 'round chains'. As shown in the drawings, link chains may comprise links that are each formed as a ring or loop. Each of the links may pass through the loops formed by adjacent links on either side. Chains 16 may, for example, comprise TECDOS™ heavy-duty chains available from the RUD Group of Aalen, Germany. In this case, one or more of the rollers about which the chain 16 circulates may be a pocket wheel. The chain 16 may be driven to circulate by driving rotation of one or more of the pocket wheels. FIGS. 1C and 1D show an example pocket wheel 29A configured with pockets 29B which are configured to receive links 16C of a drive chain 16.

Rotor 12 includes a drive ring 19. An outer periphery of drive ring 19 is formed with driven features which engage driving features of chains 16. For example, the driven features may comprise pockets or recesses 18 which are spaced and dimensioned to receive individual links 16C of chains 16. Torque can therefore be transferred to rotor 12 by driving chains 16 so as to rotate rotor 12. The pockets, teeth or other driven features of drive ring 19 may be formed, for example, by casting, machining, assembled as composites of parts shaped in 2-dimensions or the like.

In the embodiment illustrated in FIG. 1, chains 16 have links that are in the plane of drive ring 19 that alternate with links that are essentially perpendicular to drive ring 19. In this embodiment, the links perpendicular to drive ring 19 may serve as driving features and the pockets or recesses 18 in drive ring 19 that receive these links may serve as driven features.

In the embodiment shown in FIG. 1, chains 16 respectively circulate about guides 17. Guides 17 prevent the two oppositely moving sides of a chain 16 from contacting one another and may also assist in preventing displacement of chain 16 out of the plane in which chain 16 circulates. Guides 17 may also help to keep chains 16 engaged with rotor 12.

The drive mechanism illustrated in FIG. 1 has the advantage that it can accommodate some displacements of rotor 12 without interfering with the ability to turn rotor 12. For example, if rotor 12 is placed around a tubular such that the center of rotation of rotor 12 is not exactly coincident with the longitudinal axis of the tubular, operation of the gripping mechanism 20 may center rotor 12 relative to the tubular. This may change the location of the axis of rotor 12 relative to frame 11. A drive mechanism 15 as described above can accommodate some motion of rotor 12 as may result, for example, when rotor 12 is centered relative to a tubular. As another example, if the gripping mechanism grips a tubular in a manner that the longitudinal axis of the tubular is not exactly coincident with the center of rotor 12 then the fact that the drive mechanism is compliant can allow rotor 12 to rotate with some degree of runout.

Apparatus 10 includes a gripping mechanism 20 which includes actuators 22. Actuators 22 may be actuated to advance or retract jaws 23 or other gripping members that can engage and hold a tubular or other elongated object. Any of a wide range of linkages and styles of actuator may be used to advance and retract jaws 23. Examples include hydraulic cylinders, cams, electromechanical actuators, etc.

Figure 1A:
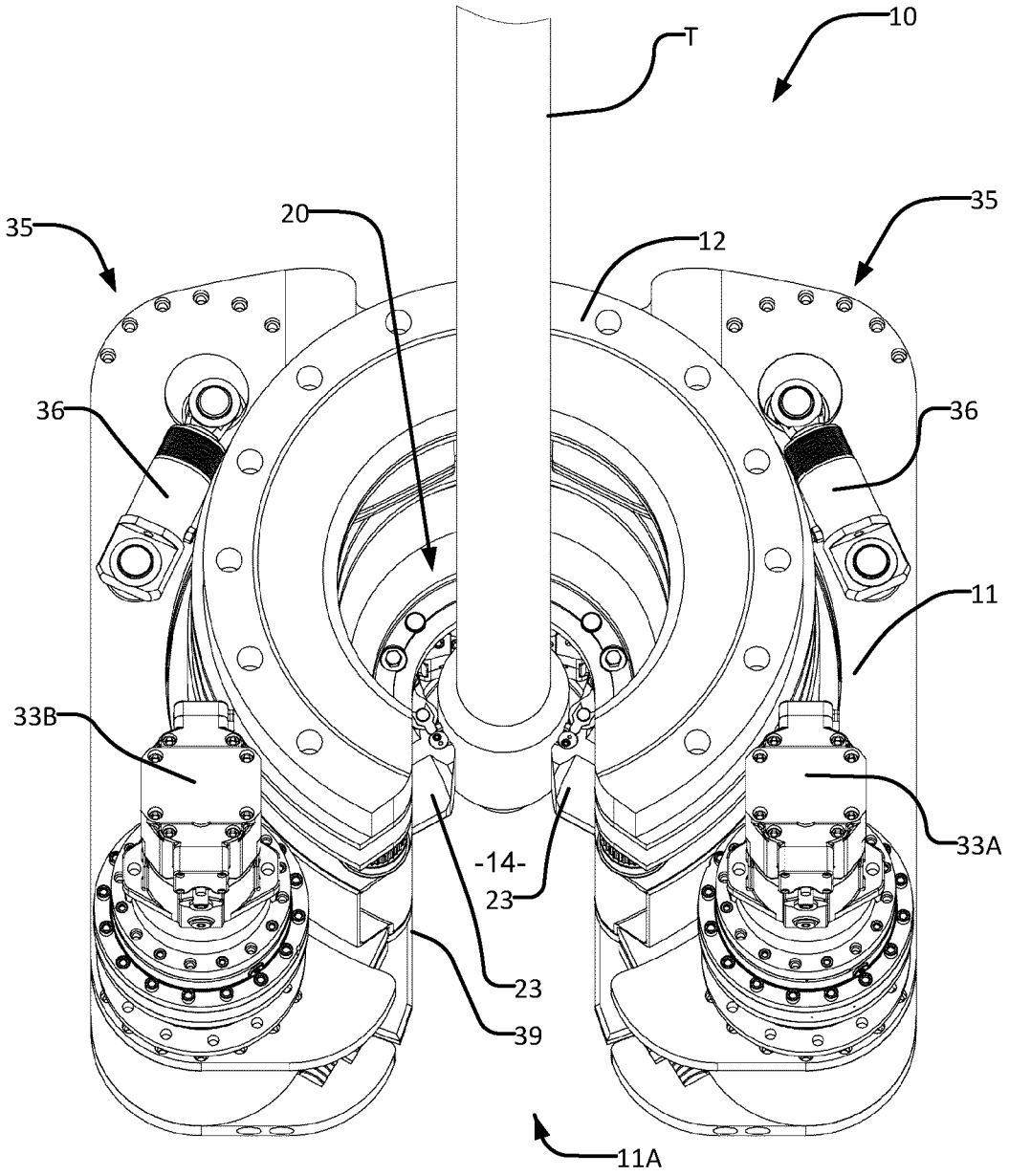
FIGS. 1A and 1B are respectively perspective and plan views showing apparatus like that shown in FIG. 1 gripping an elongated object such as a tubular.
Figure 1B:
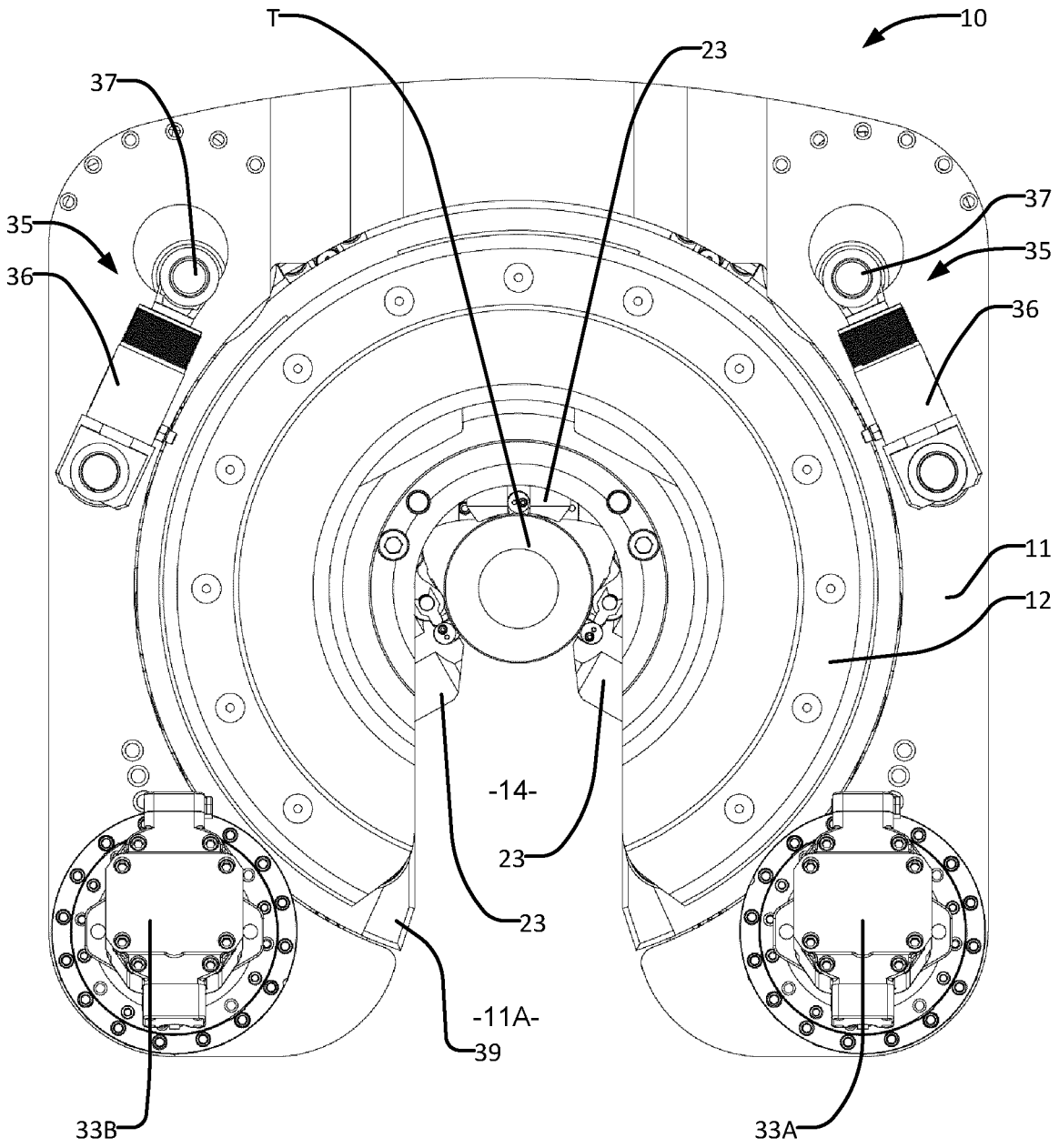
Figure 1C:
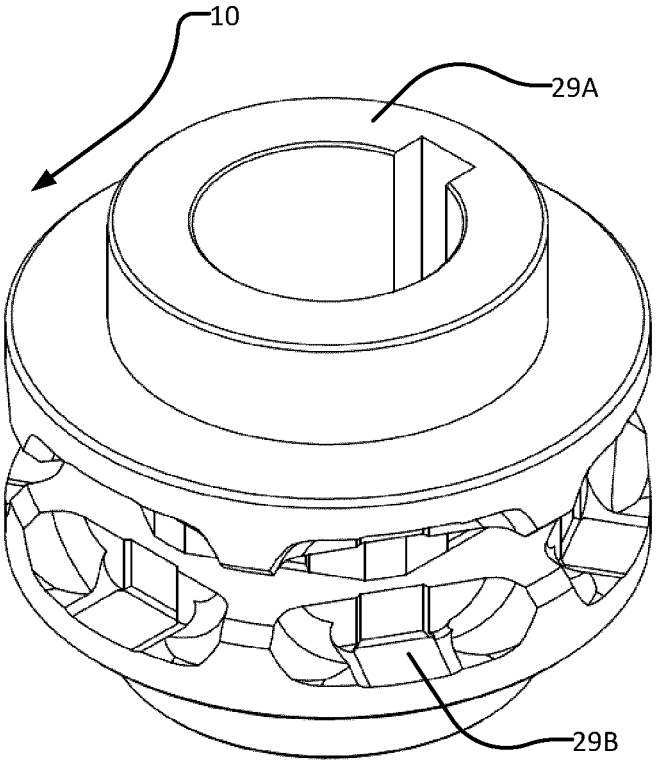
FIGS. 1C and 1D show an example pocket wheel.
Figure 1D:
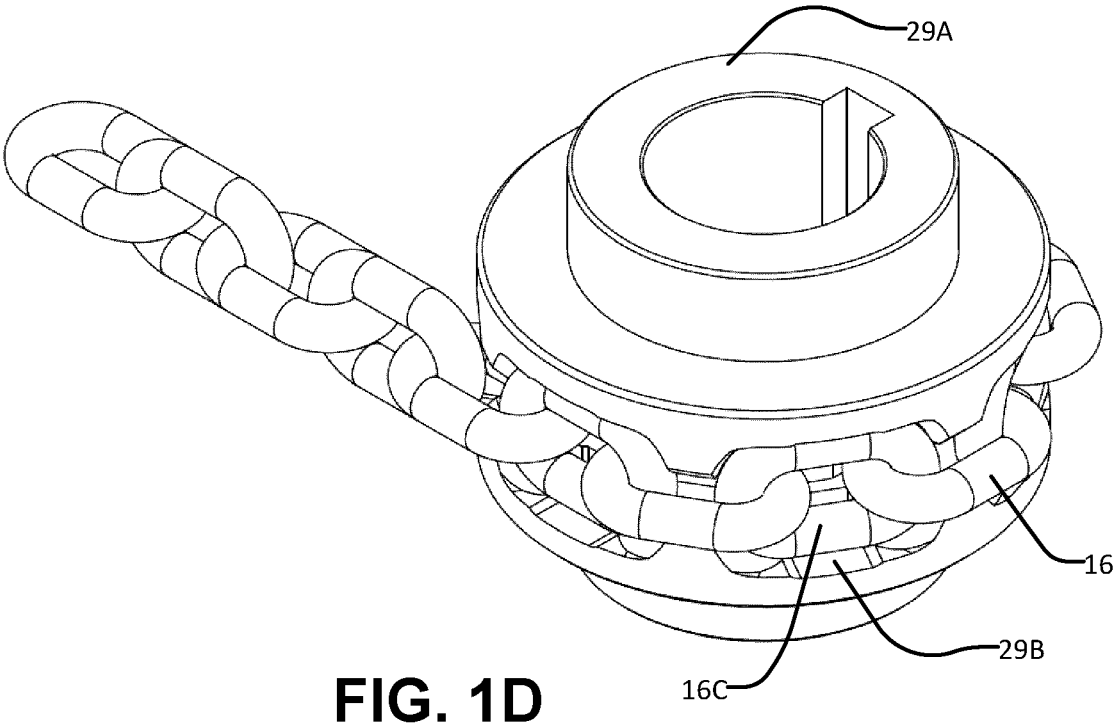

FIGS. 1A and 1B show apparatus 10 like that shown in FIG. 1 gripping an elongated object such as a tubular T. In the illustrated embodiment the tubular T is gripped by three jaws 23. Jaws 23 are designed such that, when retracted, they do not obstruct passage of tubular T travelling laterally through gap 14. Examples of a suitable arrangement of jaws 23 and actuators 22 are described in U.S. Pat. Nos. 8,109,179, 8,863,621, or U.S. patent application Ser. No. 14/296,941 or Ser. No. 13/669,419, all of which are hereby incorporated herein by reference for all purposes.

The illustrated apparatus 10 also includes a mechanism 25 for providing power on board rotor 12 for purposes such as operating actuators 22. Any embodiment may include such a mechanism. This mechanism may, for example, be substantially as described in U.S. Pat. Nos. 8,109,179, 8,863,621, or U.S. patent application Ser. No. 14/296,941 or Ser. No. 13/669,419, all of which are hereby incorporated herein by reference for all purposes. In the context of the present disclosure, such mechanisms have the added advantage that they may be constructed to accommodate a range of transverse displacements of rotor 12.

FIG. 1 shows mechanism 25 as including generators 26 (which may comprise, for example, one or more electrical generators and/or one or more hydraulic fluid pumps and/or one or more pneumatic pumps). One or more generators 26 may be provided. Generators 26 are driven by rotation of drive sprockets 28. A synchronizing belt 27 causes all drive sprockets 28 to rotate together. Drive sprockets 28 are driven by external moving surfaces (not shown in FIG. 1 but see FIG. 7F) which are arranged such that they do not obstruct the opening of gap 14 for at least one orientation of rotor 12. The moving surfaces may, for example, be provided by one or more serpentine belts.

As an alternative to generating power on board rotor 12, electric, hydraulic and/or pneumatic power may be supplied to rotor 12 from an external source by way of an umbilical that couples to rotor 12. Such embodiments may not permit unlimited rotation of rotor 12. In some embodiments rotor 12 is controlled so that it can be turned through no more than a predetermined angle in either direction. That predetermined angle may optionally exceed 360 degrees.

Figure 4A:
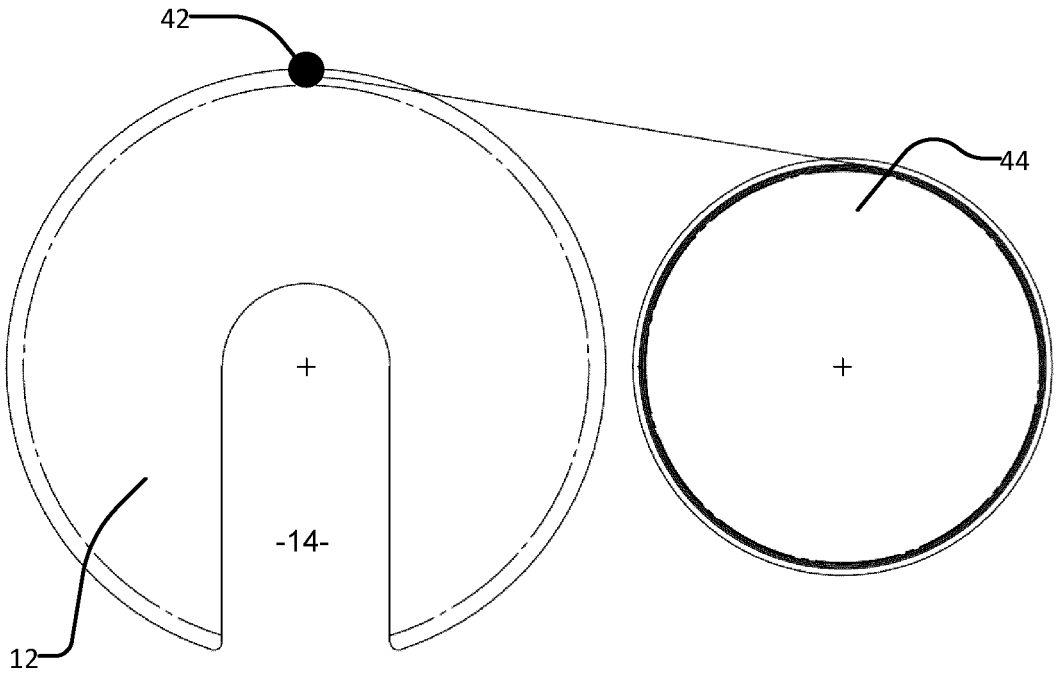
FIGS. 4A and 4B are a schematic views showing one way to provide power to a rotor from an external source.
Figure 4B:
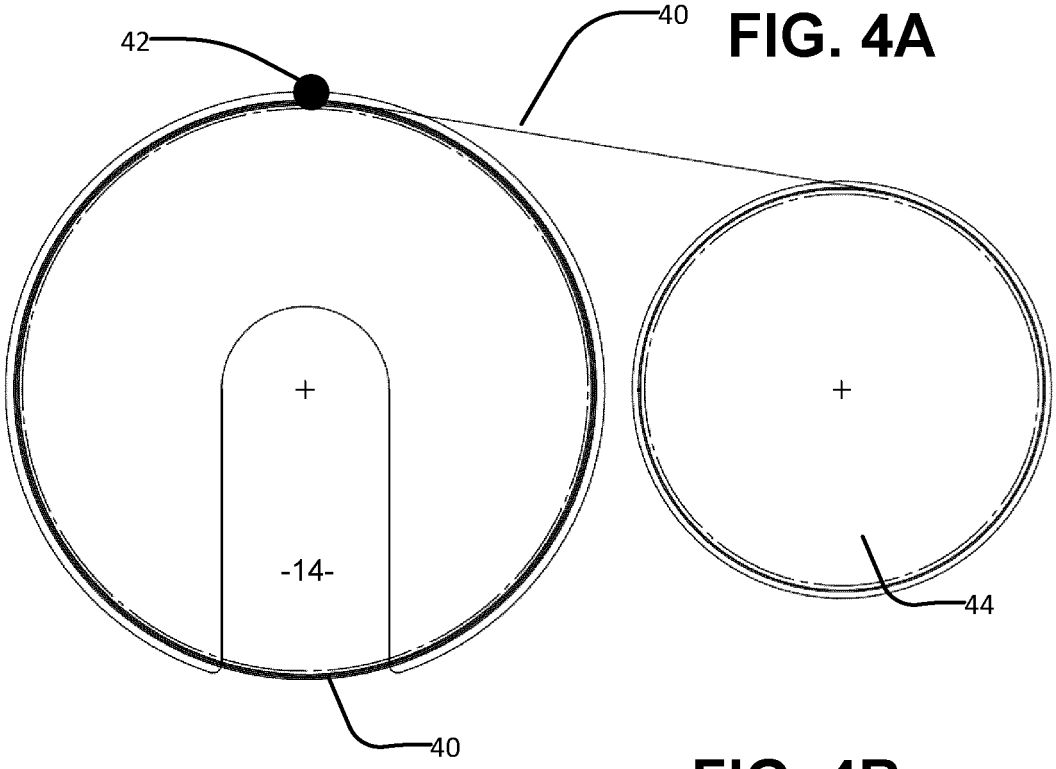

FIGS. 4A and 4B show an example embodiment in which an umbilical 40 supplies power to rotor 12. Umbilical 40 may connect to rotor 12 at a rotatable coupling 42. Umbilical 40 may comprise multiple conduits such as pressure and return hydraulic lines and/or plural electric wires for delivering power and/or signal conductors such as signal wires or optical fibers. In the embodiment of FIGS. 4A and 4B, umbilical 40 is stored on a spring-loaded reel 44 such that umbilical 40 is automatically payed out and reeled in as rotor 12 is turned. In other embodiments umbilical 40 may be fixed at both ends. In FIG. 4A, umbilical 40 is wrapped one or more times around rotor 12. In FIG. 4B, rotor 12 has been turned back to a position in which umbilical 40 does not cross gap 14. Reel 44 has taken in umbilical 40.

In other embodiments umbilical 40 may be stored in a loop, festoon or other arrangement that allows umbilical 40 to be wound around rotor 12 as rotor 12 is turned in one direction and then taken up as rotor 12 is turned in the opposite direction.

In some embodiments umbilical 40 is extendable to wrap around rotor 12 sufficiently for rotor 12 to be turned through 4, 5 or more turns. In some embodiments a length of 5 or more feet (about 1.7 m or more) of umbilical 40 is wrapped around rotor 12 for each full rotation of rotor 12. A control system may halt rotation of rotor 12 (e.g. after a predetermined number of turns) such that umbilical 40 is not damaged or over-extended. The control system may then reverse rotation of rotor 12 to allow umbilical 40 to be taken up by reel 44 or other mechanism for retraction of umbilical 40.

It is not mandatory that drive mechanisms 15 use link chains as depicted in FIG. 1. Drive mechanisms 15 provide circulating flexible elements which each provide drive features spaced apart by a pitch distance. For example, the flexible drive elements may comprise toothed belts (with teeth facing outwardly—in which case the pitch distance is defined by the spacing of the teeth, roller chains—in which case the pitch distance is defined by the spacing of the rollers, link chains—in which case the pitch distance is defined by the spacing of the links, toothed chains—in which case the pitch distance may correspond to the spacing between teeth along the toothed chain, or the like).

Where toothed belts are used to drive rotor 12 the belts may be toothed on both sides or on only one side. A belt toothed on only one side may be driven with the teeth facing outwardly by guiding the belt so that a portion of the outside of the belt wraps around a driving sprocket as illustrated, for example, in U.S. Pat. No. 9,017,194 which is hereby incorporated herein by reference for all purposes.

Figure 2A:
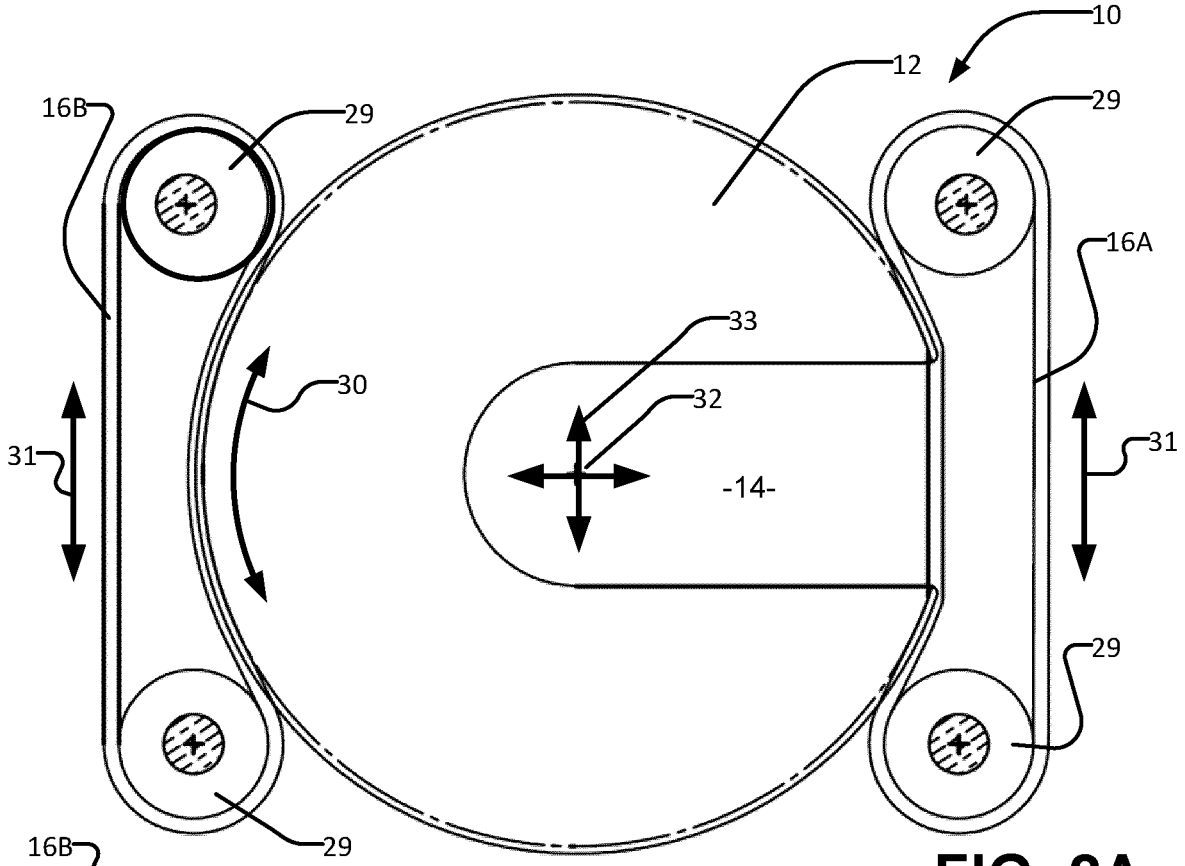
FIGS. 2A and 2B are schematic illustrations showing mechanisms for driving rotation of a rotor of apparatus of the type described herein.
Figure 2B:
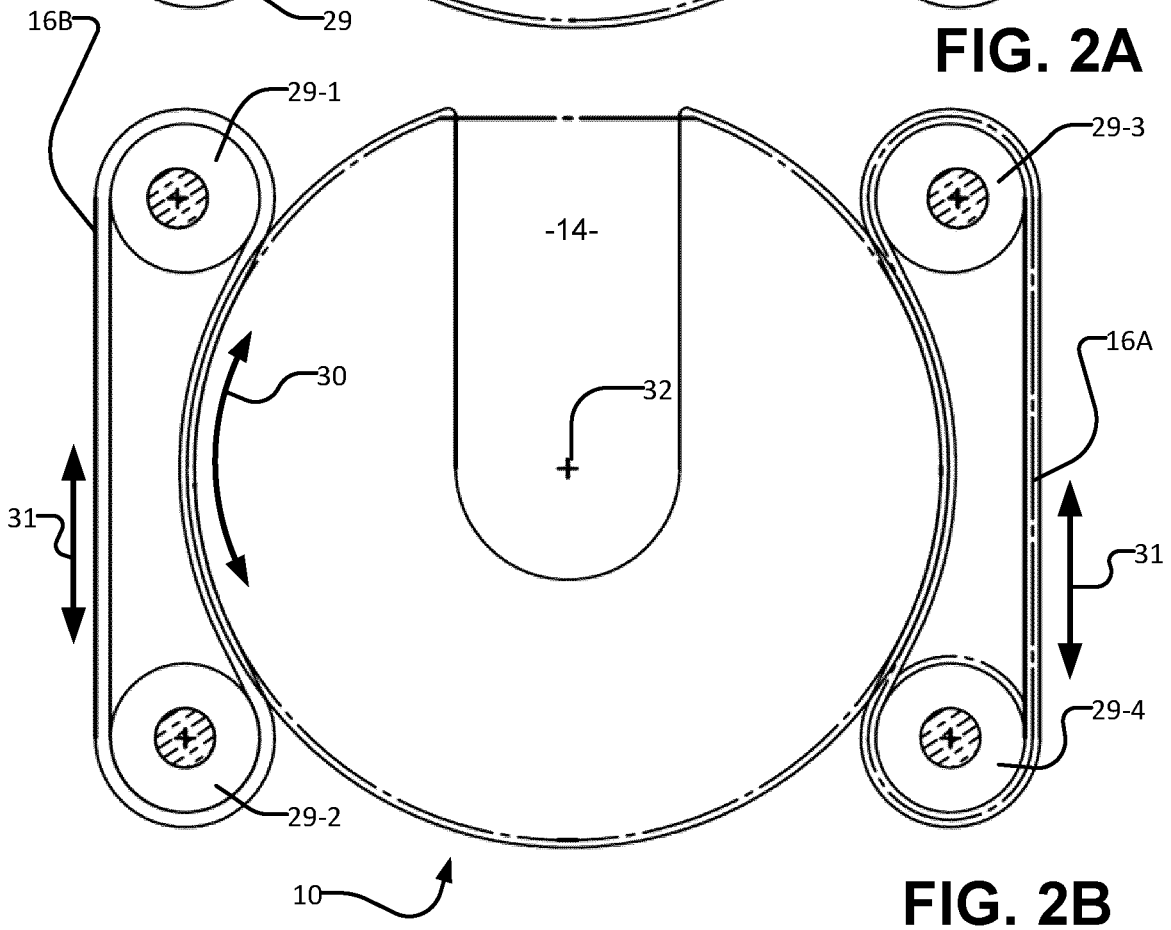
Figure 2C:
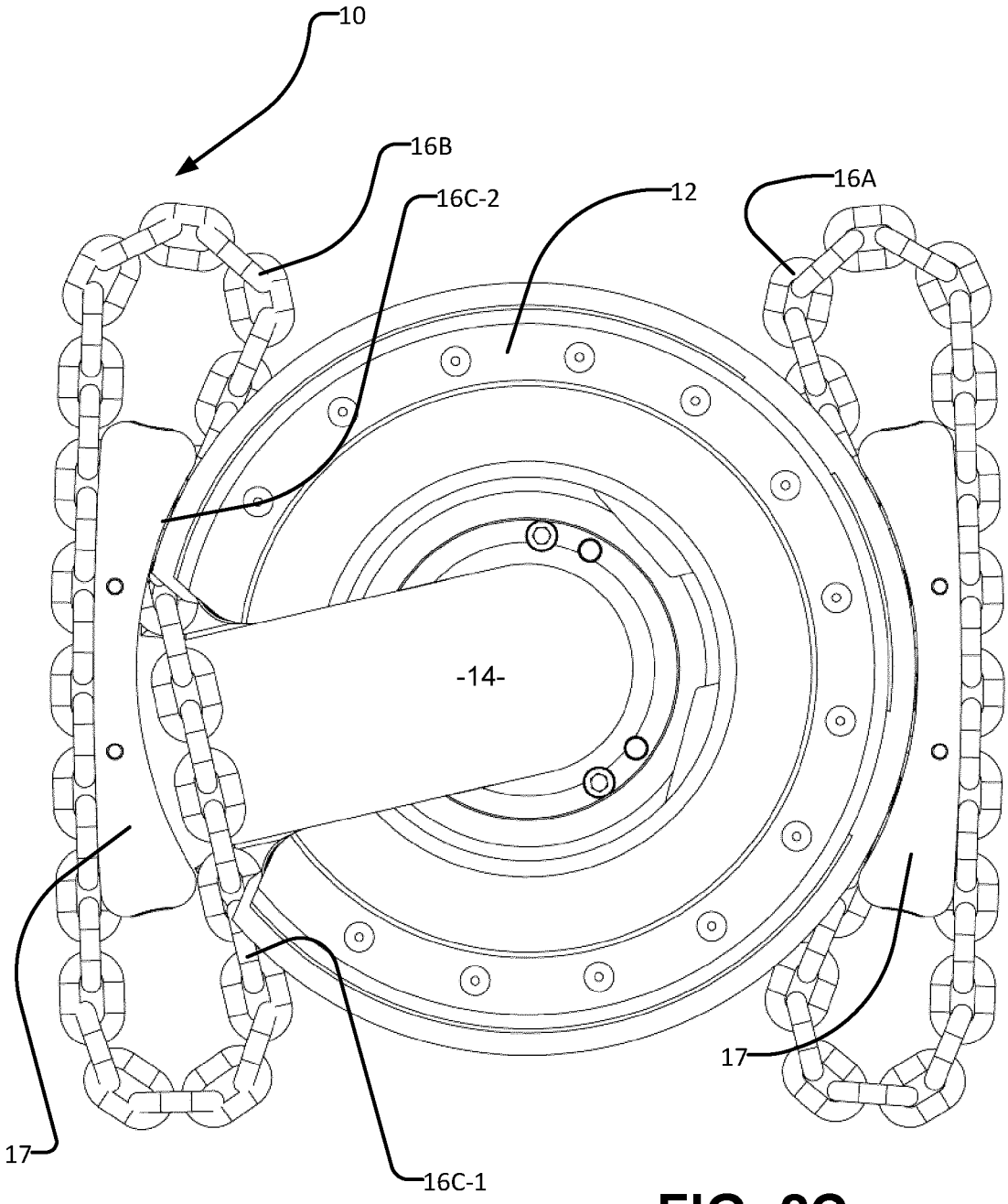
FIGS. 2C and 2D are cut away views showing the rotor of the apparatus of FIG. 1 at two different angular orientations.
Figure 2D:
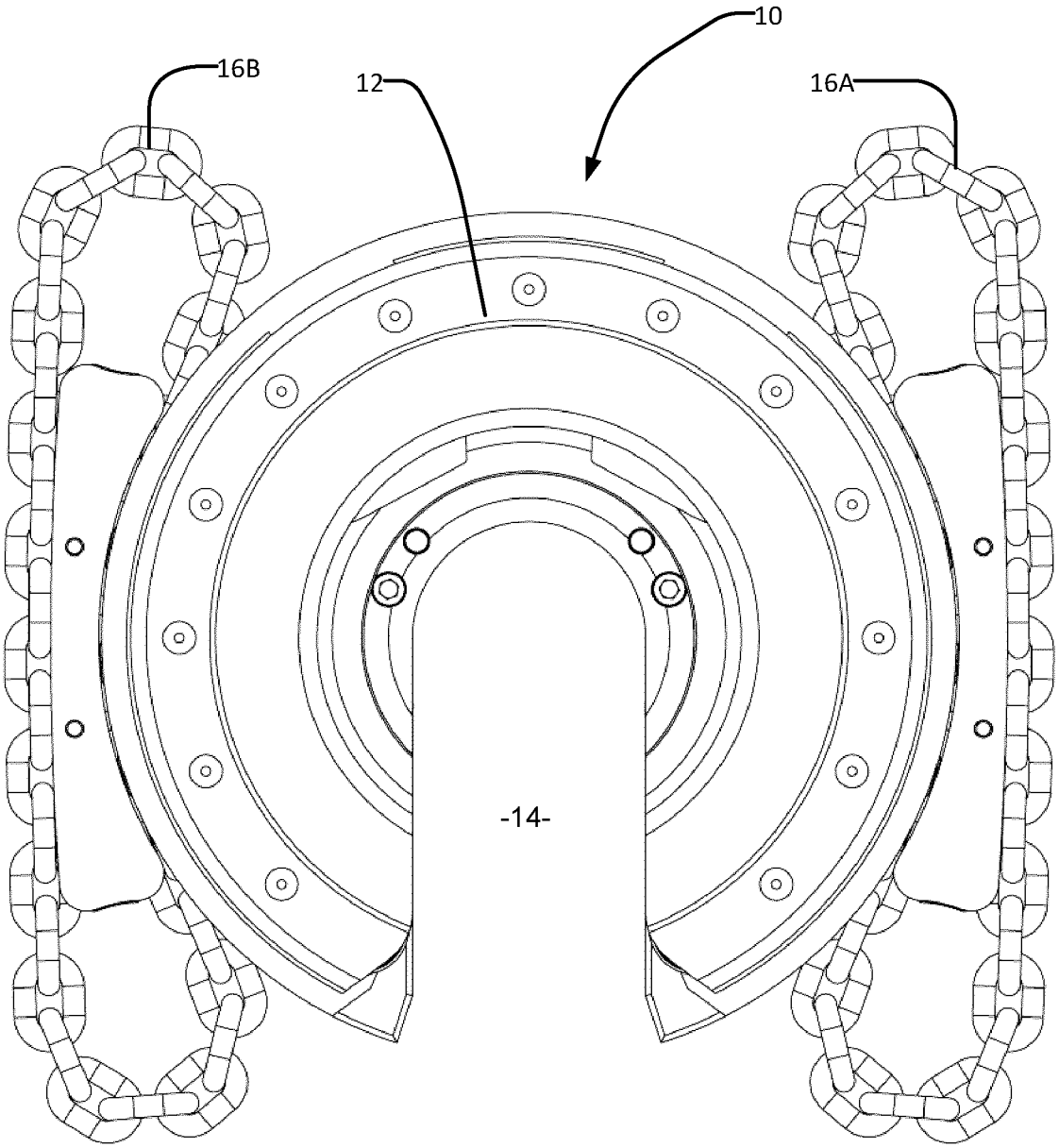

FIGS. 2A and 2B depict example embodiments in which drive members are generalized circulating elements 16A and 16B that are each passed around a plurality of rollers 29. In each drive mechanism 15, two rollers 29 are spaced apart around the circumference of rotor 12. Rotor 12 causes those parts of flexible elements 16A and 16B that contact rotor 12 to be deflected outwardly (e.g. into the space between the two rollers 29). This holds the flexible elements against rotor 12. The components of forces applied by the flexible elements in a direction through the center of rotation of the rotor may be essentially equal and opposite.

Circulating flexible elements 16A and 16B as indicated by arrows 31 allows rotor 12 to be caused to turn in either direction about center of rotation 32 as indicated by arrows 30. At the same time, the contact of flexible elements 16A and 16B with rotor 12 is somewhat compliant such that rotor 12 is permitted to move in its plane as indicated by arrows 33. In some embodiments, rotor 12 can be displaced from a centered position by 3/16 inch (about 5 mm) or more. In some embodiments rotor 12 may be mounted in a manner that allows such transverse displacements in the range of 5 mm to 15 mm or more in any direction.

Each flexible drive element 16 is driven by one or more of rollers 29. In FIG. 2B, rollers 29 are labelled 29-1, 29-2, 29-3, and 29-4. In some embodiments, all of rollers 29-1 to 29-4 are driven. In some embodiments, only one roller 29 in contact with each flexible drive element is driven. For example, rollers 29-1 and 29-3 may be driven while rollers 29-2 and 29-4 are not driven or vice versa. As another example, rollers 29-1 and 29-4 may be driven while rollers 29-2 and 29-3 are not driven or vice versa. As another example, flexible drive elements 16 may pass around one or more additional rollers (not shown). The additional rollers may include non-driven idler rollers and/or driven rollers.

Selection of which rollers to drive or not drive may be guided by considerations such as power requirements, cost, physical form factor, and whether the torque requirements for driving rotor 12 in clockwise and counterclockwise directions are the same or different.

It is generally most mechanically efficient to drive the roller 29 that is leading in the direction of rotation of rotor 12. For example, if rotor 12 as shown in FIG. 2B is being turned clockwise, the leading rollers are 29-1 and 29-4. If rotor 12 is being turned counterclockwise, the leading rollers are 29-2 and 29-3. In some embodiments, two drive mechanisms are provided and one of rollers 29 is driven in each drive mechanism 15. In some cases, the driven rollers are adjacent to one another (e.g. rollers 29-1 and 29-3 or rollers 29-2 and 29-4 in FIG. 2B). This arrangement has the advantage that for either direction of rotation of rotor 12, one of the drive mechanisms 15 is turning in the preferred direction (i.e. with the leading one of rollers 29 being driven). This arrangement may have the further benefit of concentrating the bulk of motors or other drive components on one side of the apparatus.

In a case where maximum torque is required in one direction of rotation of rotor 12, it may be advantageous to drive those rollers 29 that are leading in that direction.

Advantageously, the pitch of flexible elements 16A and 16B may be matched to the circumference of drive ring 19 and the width of gap 14 such that during a continuous rotation of rotor 12, the driving features of flexible elements 16A and 16B remain aligned with and engaged with driven features 18 on drive ring 19 without significant misalignment. For example, as shown in FIG. 1, the length of links 16C of chains 16A and 16B, the circumference of drive element 19 and the width of gap 14 may be chosen such that, during continuous rotation of rotor 12, links 16C remain aligned with the corresponding recesses 18 in drive ring 19 that they engage.

From FIGS. 2A and 2B it can be seen that the configuration of the portions of flexible elements 16A and 16B that engage rotor 12 will vary depending on whether or not the flexible drive element is spanning gap 14. As shown in FIG. 2A, the portion of drive element 16A spanning gap 14 forms a straight line, whereas, the portion of drive element 16B which contacts rotor 12 outside of gap 14 forms an arc.

Figure 3A:
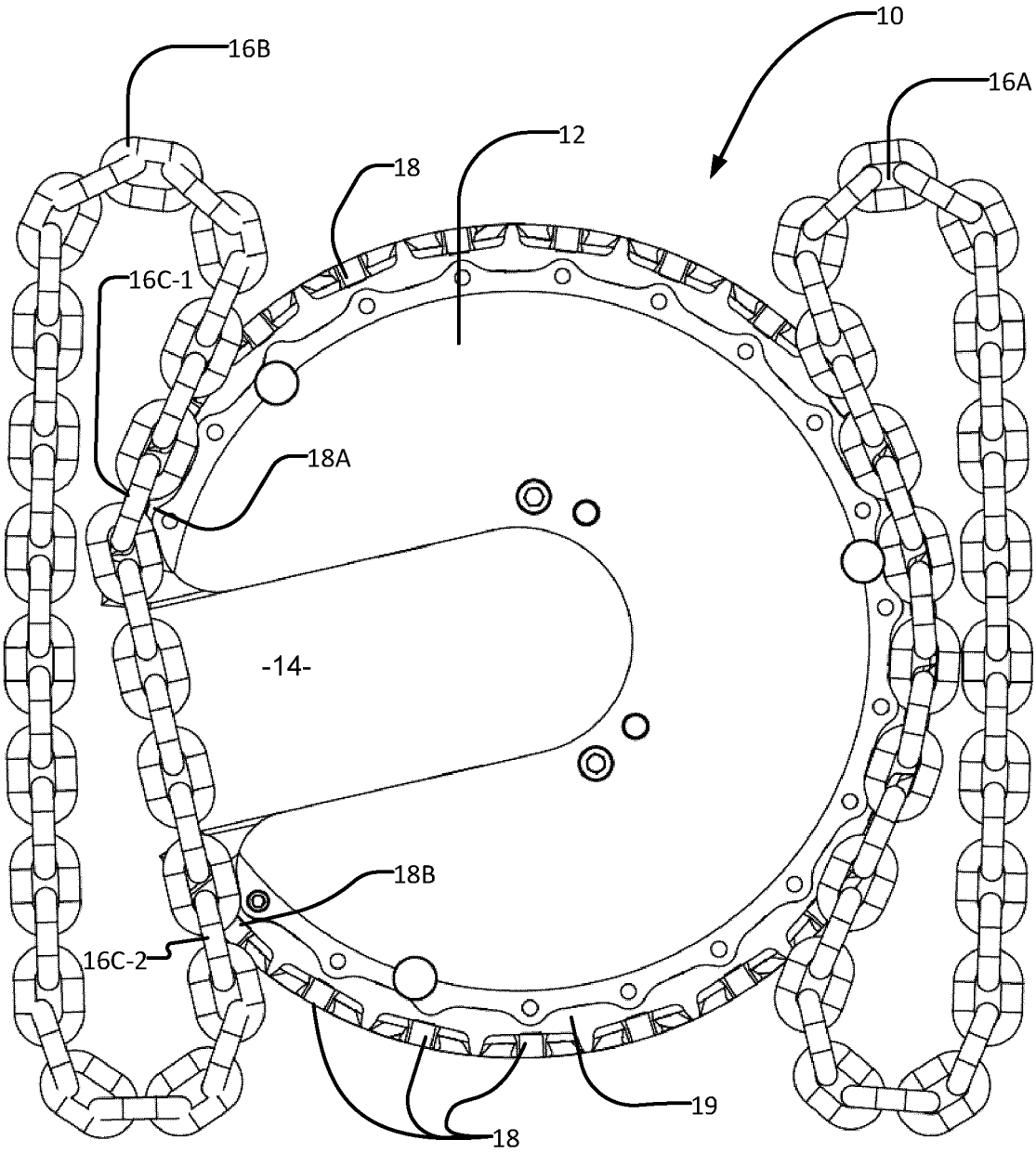
FIGS. 3A and 3B show the rotor of the apparatus of FIG. 1 as shown in FIG. 2C further cut away to show engagement of a drive chain with drive pockets on the rotor. The views of FIGS. 3A and 3B show one side of a drive ring.
Figure 3B:
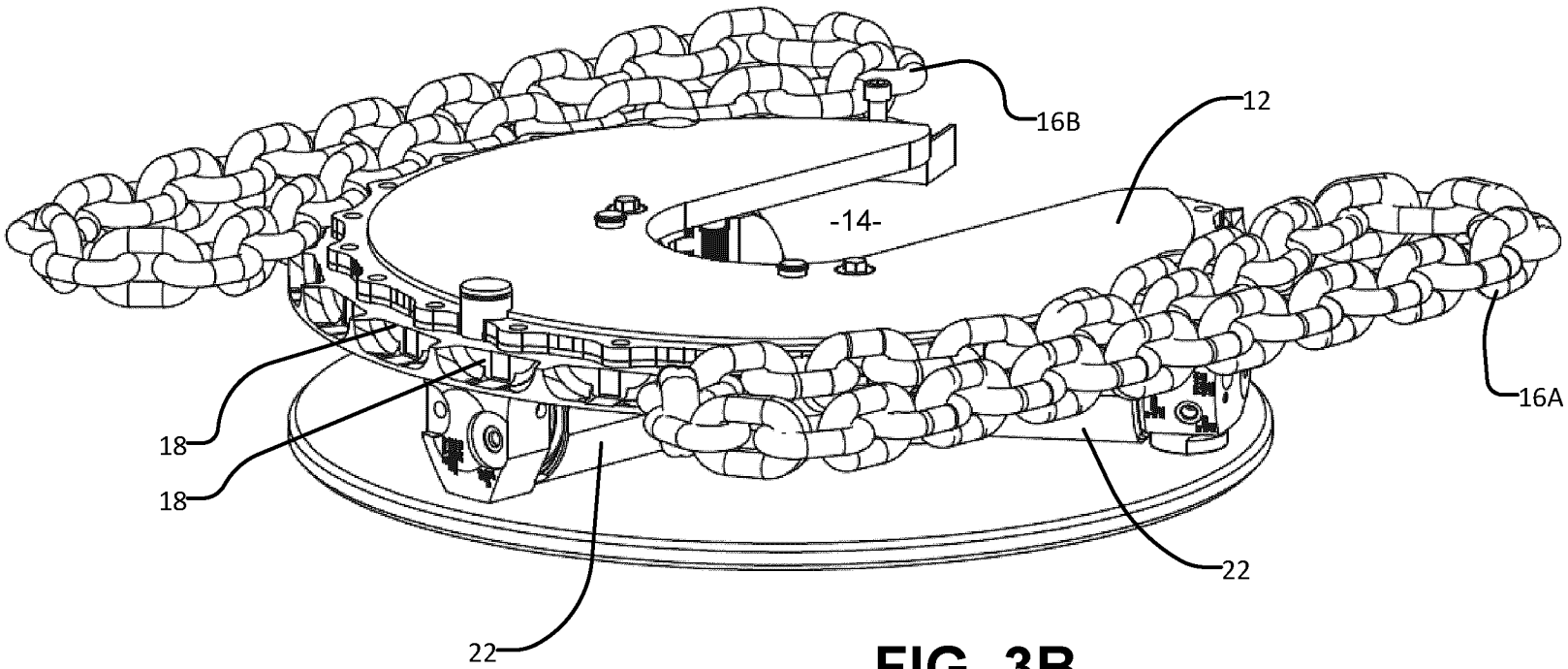
Figure 8:
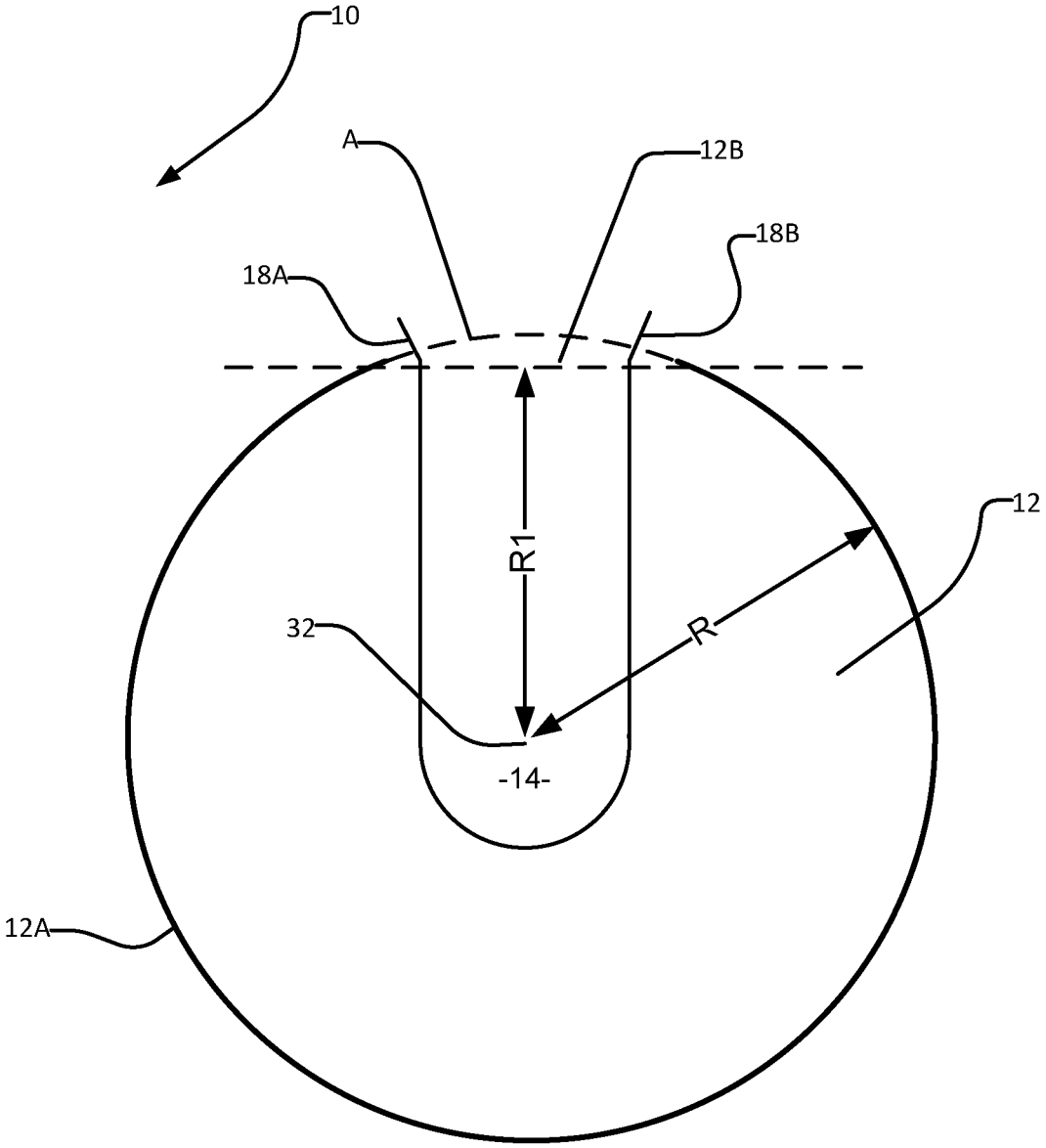
FIG. 8 is a schematic drawing illustrating certain geometrical features of an example rotor.

One can maintain proper alignment between the driving features of the flexible driving elements 16 and corresponding driven features on rotor 12 by making driven features 18A and 18B which are the driven features 18 closest to gap 14 on either side of gap 14 between which the flexible driving element may extend across gap 14 an integer number of pitch distances apart both along a path that includes a straight line segment across gap 14 and also in the opposite direction following the curved circumference of rotor 12. This is illustrated in FIGS. 3A and 8. Chain 16B on the left hand side of FIG. 3A crosses gap 14. Pockets 18A and 18B on either side of gap 14 receive the first links of chain 16A on either side of gap 14. Pockets 18A and 18B are spaced apart such that a portion of chain 16A can be stretched tightly across gap 14 between links 16C-1 and 16C-2 on either side of gap 14 that are engaged respectively in recesses 18A and 18B. In the other direction traversing around the periphery of drive ring 19, there are an integer number of pitch distances between pockets 18A and 18B with other pockets 18 spaced one pitch distance apart.

Rotor 12 may, for example, have a circular outer periphery except in the vicinity where gap 14 meets the periphery. The pitch of pockets 18 or other drive features on the curved periphery of rotor 12 may be such that a circumference of a circle having the same radius as the curved periphery of rotor 12 is not an integer multiple of the pitch distance. This is illustrated in FIG. 8 which schematically shows a rotor 12 in plan view. The outer periphery of rotor 12 follows a circle A except in the vicinity of gap 14 where a flexible drive member may span across gap 14 in a straight line section which is a chord of circle A. A first part 12A extends between driven features 18A and 18B on either side of gap 14. A second part 12B extends between driven features 18A and 18B in a straight line that crosses the opening of gap 14. Each of first part 12A and second part 12B has a length measured along its path that is an integer number of pitch distances P of corresponding drive members 16 (not shown in FIG. 8). In at least most cases the circumference of circle A ($\pi \times D$ where D is the diameter of circle A) does not divide evenly by P. In some embodiments the circumference of circle A that defines most of the periphery of rotor 12 divided by the pitch distance yields a value in the range of 25 to 150 although values outside this range are also possible.

In any of the embodiments described herein a perpendicular distance from the midpoint of a straight line that crosses gap 14 between points 18A and 18B to a center axis of rotor 12 is optionally at least 90% of a radius of a circle that defines the periphery of second part 12B. FIG. 8 shows perpendicular distance R1 and radius R. Preferably $R1/R \geq 0.9$.

The pitch distance may be chosen such that at all orientations of rotor 12 multiple driving features of circulating elements 16 are engaging multiple driven features on rotor 12.

In FIG. 1, rotor 12 further comprises a centering mechanism 21 comprising members 21A that may be actuated to center a tubular or other elongated member to extend along the axis of rotation of rotor 12. Centering mechanism 21 may, for example, comprise actuated arms. Centering mechanism 21 may also control axial movement of rotor 12. In some embodiments, centering mechanism 21 supports the weight of rotor 12. Such a centering mechanism may be provided in any embodiment.

Figure 5A:
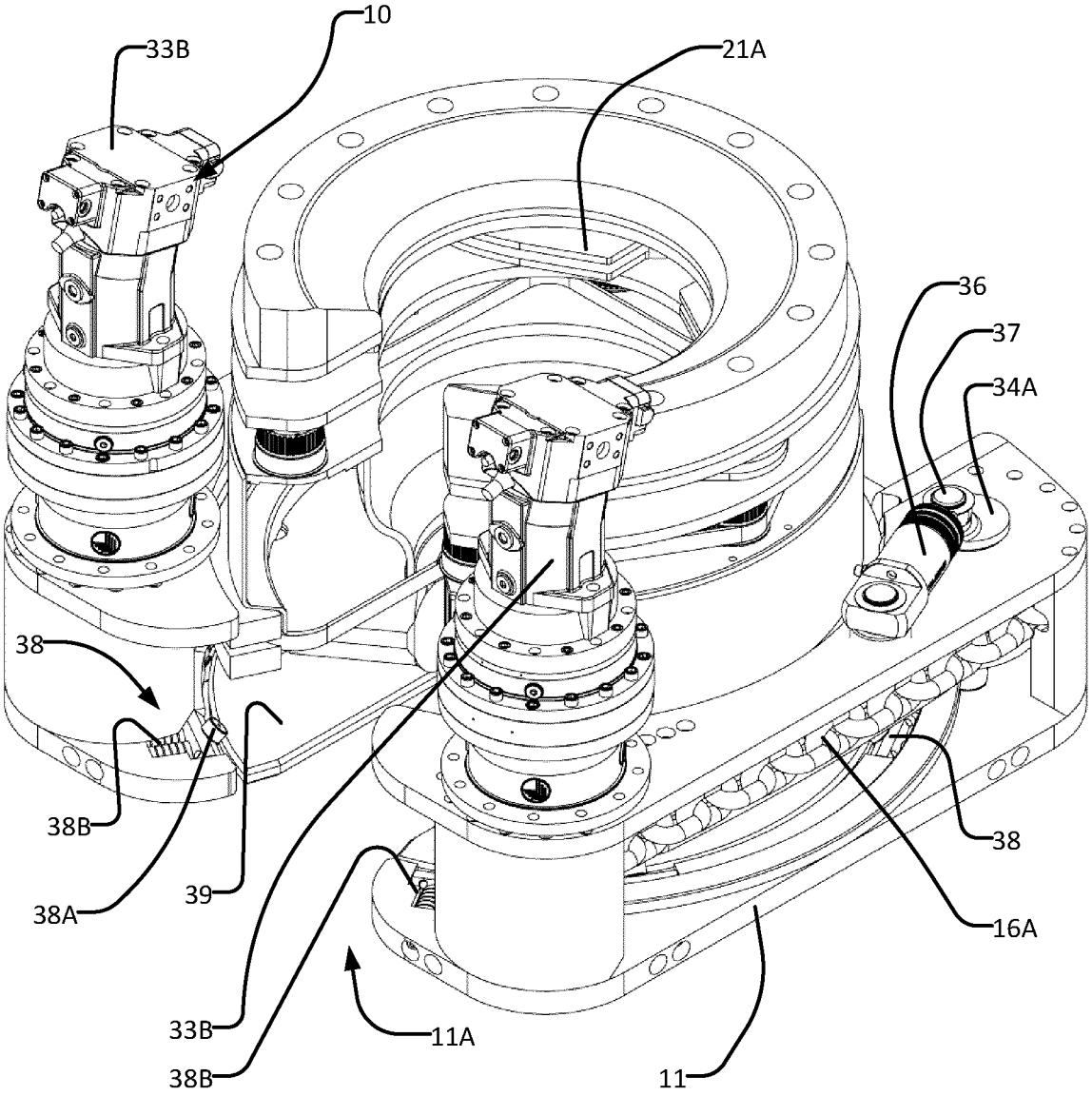
FIGS. 5A and 5B are perspective views of apparatus like that shown in FIG. 1 illustrating some possibilities for positioning of drive motors.
Figure 5B:
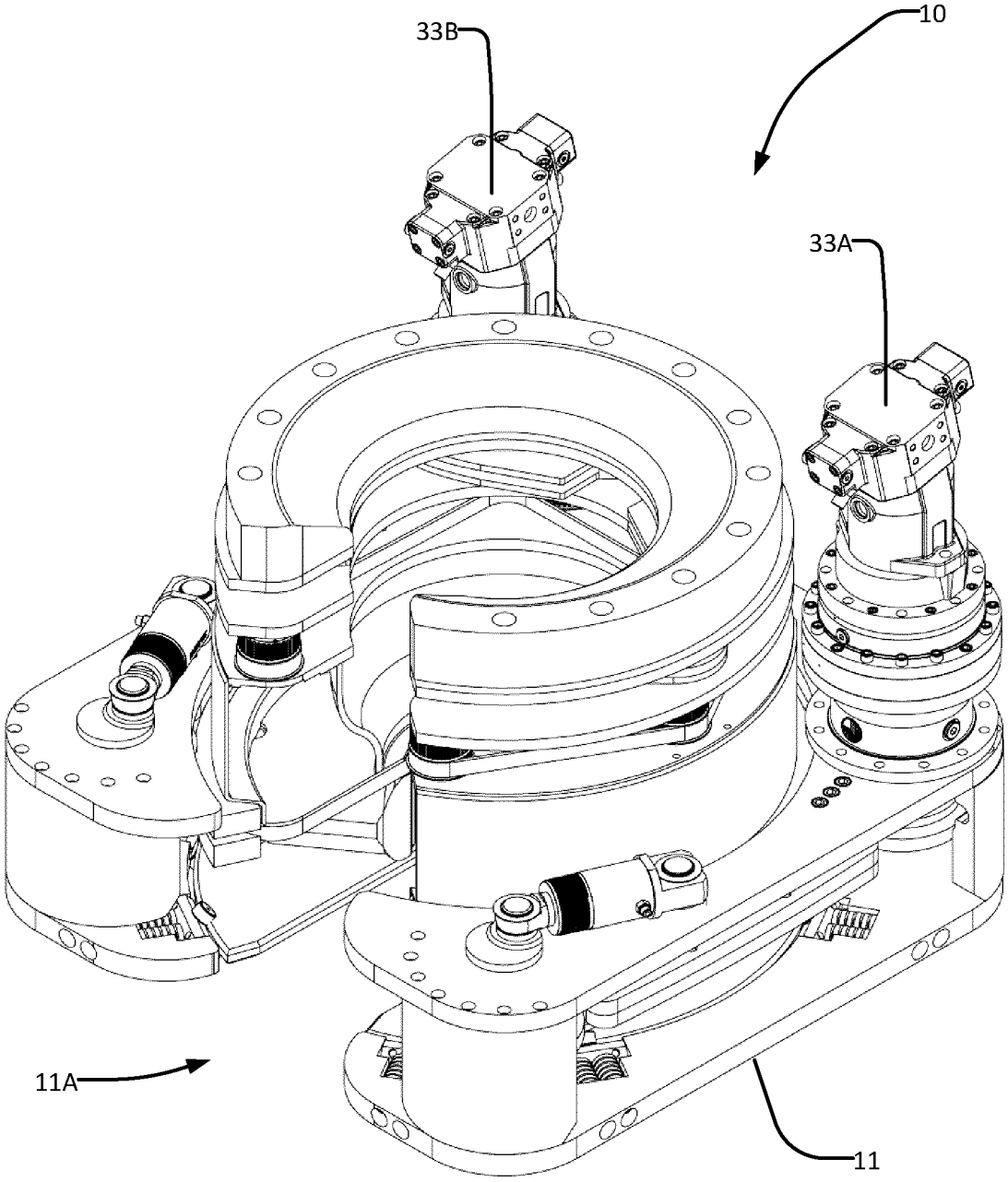

FIG. 1 omits depicting mechanisms for driving chains 16A and 16B for clarity. FIGS. 5A and 5B show apparatus like that of FIG. 1 with the addition of drive motors 33A and 33B and frame 11. Drive motors 33A and 33B respectively drive rollers which may, for example, have the form of pocket wheels, sprockets, drive sheaves, or the like which cause chains 16A and 16B or other flexible drive elements 16 to circulate around their paths. Drive motors 33A and 33B may be located to drive any sheave(s) in driving connection with chains 16A and 16B. FIG. 5A shows an example embodiment in which drive motors 33 are provided on the side of frame 11 adjacent to opening 11A. FIG. 5B shows a similar embodiment in which motors 33 are provided on the side of frame 11 away from opening 11A. FIGS. 1C and 1D show a pocket wheel 29 that may be applied to drive a link chain 16 or used as an idler roller for a link drive chain 16.

Drive motors 33A and 33B may comprise fluid-driven motors such as hydraulic motors or pneumatic motors or electric motors, for example. Drive motors 33A and 33B may incorporate gear reduction units or other power transmission components.

In an alternative embodiment a power-transmission system such as a drive shaft may drive a flexible element 16 from a remotely-located power source. It is not mandatory that only one motor be provided to drive each flexible element 16. In some alternative embodiments one or more flexible elements 16 is driven by plural driven rotating members.

FIG. 5A also shows tensioning mechanisms 35. Tensioning mechanisms 35 maintain chains (or other flexible elements) 16 under tension. Tensioning mechanisms 35 may be provided in any embodiment. In the illustrated embodiment, each tensioning mechanism 35 comprises an actuator 36 which acts on an eccentric pin 37 to cause displacement of a corresponding idler roller that carries a chain 16. In some embodiments, actuators 36 comprise hydraulic actuators.

Other tensioning mechanisms may be used. For example one or more of:

- a biased idler wheel;
- mounting one of rollers 29 to slide along a linear or curved track and providing an actuator to apply a desired tension;
- a biased guide bar;

are some non-limiting ways to tension a drive member 16.

Actuators 36 may be operated so as to increase tension in a drive member 16 (e.g. chain 16A) in proportion to the torque being imparted to rotor 12. In some embodiments this is achieved by supplying actuators 36 with hydraulic fluid pressurized to a level in proportion to the pressure being used to drive motors 33. For example, actuators 36 may be supplied with hydraulic fluid pressurized to the same pressure present at inlets to drive motors 33.

In some embodiments actuators 36 are controlled such that the tension in a drive member 16 (e.g. a chain or belt) depends upon the direction of circulation of the drive member 16. In some embodiments, tension in drive member 16 is automatically increased when the drive member is driven in a "reverse" direction in comparison to when the drive member is driven in a forward direction. Here, 'forward direction' is a direction such that the driven roller 29 directly pulls that portion of drive member 16 that is in driving contact with rotor 12 and reverse is the opposite direction (e.g. for drive member 16B in FIG. 2B with roller 29-1 driven, circulation counterclockwise corresponds to the 'forward direction' and circulation clockwise corresponds to the 'reverse direction').

In some embodiments a tensioning mechanism 35 comprises a spring, which provides a base level of tension and an actuator 36 that may be operated to increase a level of tension in a flexible drive member 16 above the base level provided by the spring.

These features may be combined. For example, a tensioning system 35 for drive members 16 may provide greater tension when the drive member is driven in a specific direction (e.g. reverse) and the tension may also be automatically increased with increasing load.

In addition to controlling tension in chains or other flexible drive members 16, tensioning mechanisms 35 may accommodate changes in the path length of the corresponding flexible drive member 16 as it passes over gap 14.

Figure 6:
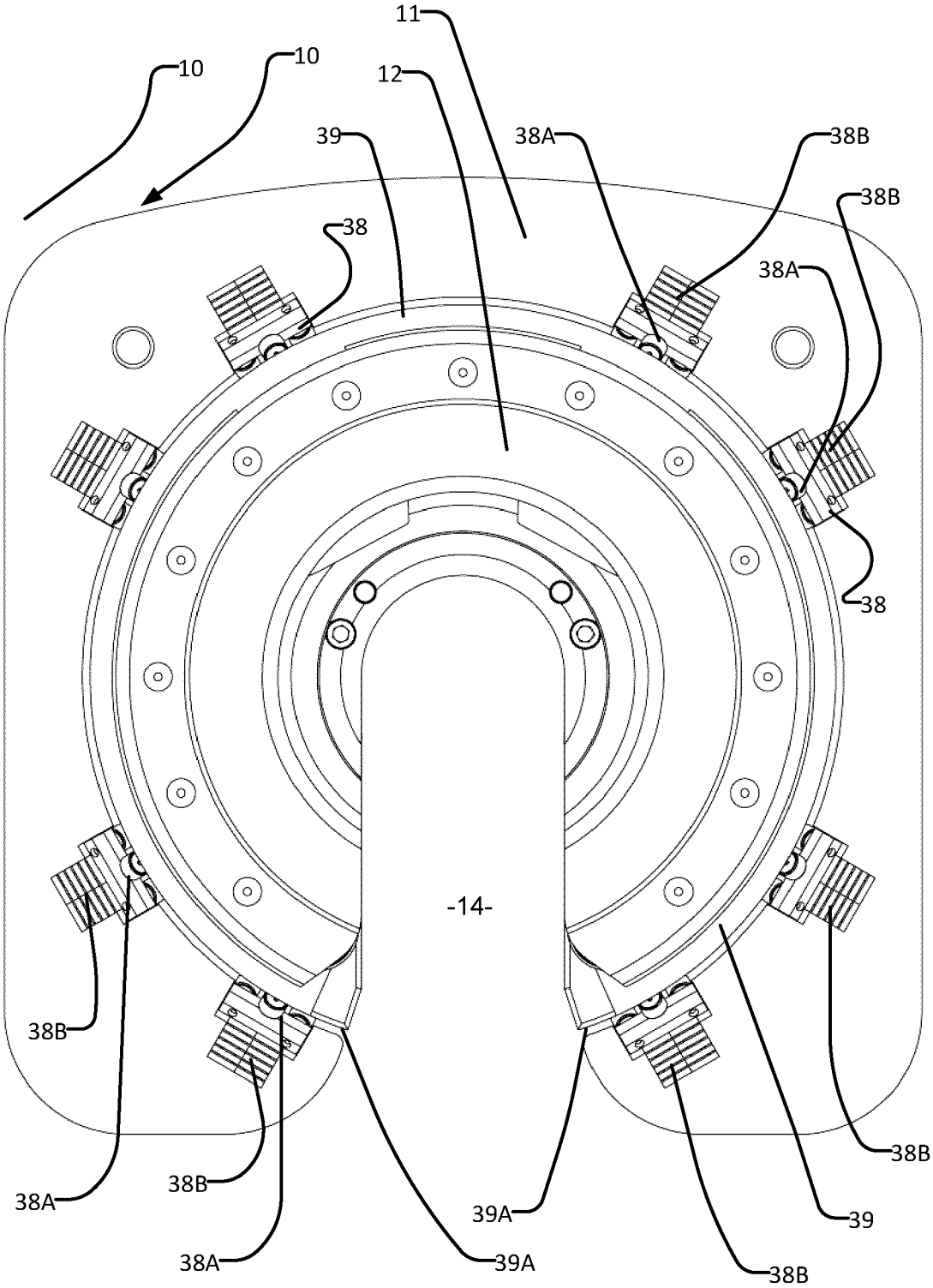
FIG. 6 is a cross-section through apparatus like that shown in FIG. 1 illustrating a resilient mounting for the rotor.

As shown in FIG. 6 as well as FIGS. 5A and 5B, a resilient centering mechanism may be provided in any embodiment to help centralize rotor 12 relative to drive mechanisms 15. In the illustrated embodiment, the centering mechanism comprises a plurality of spring-loaded roller sets 38 spaced apart around the periphery of a flange 39 projecting from rotor 12. Each roller set 38 in the illustrated embodiment comprises a body 38A which is driven toward flange 39 by a spring 38B. Rollers 38C mounted to body 38A roll along the edges of flange 39. Rollers 38C may be arranged in a V-configuration such that they constrain motion of flange 39. In some embodiments, axes of rollers 38C are arranged at a right angle to axes of other rollers 38C that contact an opposing side of flange 39.

In the illustrated embodiment, rollers 38A also support rotor 12 from moving axially. To facilitate this, bodies 38 may be constrained to move in the plane of flange 39. In the illustrated embodiment, each roller assembly includes two rollers 38A supporting flange 39 from below and one roller 38A riding on the top edge of flange 39. Points of contact between rollers 38A and flange 39 may be arranged such that rollers 38A on each body 38 are staggered circumferentially on flange 39.

Flange 39 may include a ramp portion 39A on either side of gap 14. The ramp portions 39A lead rollers 38A onto and off of flange 39 as rotor 12 turns. Ramp portions 39A are not always required since rollers 38A can roll onto the edge of flange 39 even if flange 39 is not perfectly centered.

Advantageously, in some embodiments a pair of sets of rollers 38 on either side of opening 11A are spaced apart from one another by a circumferential distance that is less than a circumferential span of gap 14 in rotor 12.

Other alternative centering mechanisms may be provided. For example, the illustrated arrangement of rollers 38A could be replaced by V-rollers or low-friction slides. Force for centering rotor 12 may be provided by springs such as spring coils or Belleville spring washers or leaf springs and/or by hydraulic or pneumatic actuators. As another example, roller assemblies may be mounted to rotor 12 and may run around a track supported by frame 11. The track may be interrupted at opening 11A.

In some embodiments rotor 12 includes a plurality of axially spaced-apart drive rings 19 each driven by one or more drive mechanisms 15. For example, two drive rings 19 each driven by two drive mechanisms 15 of the type illustrated in FIG. 1 may be axially spaced-apart along rotor 12.

Figure 7:
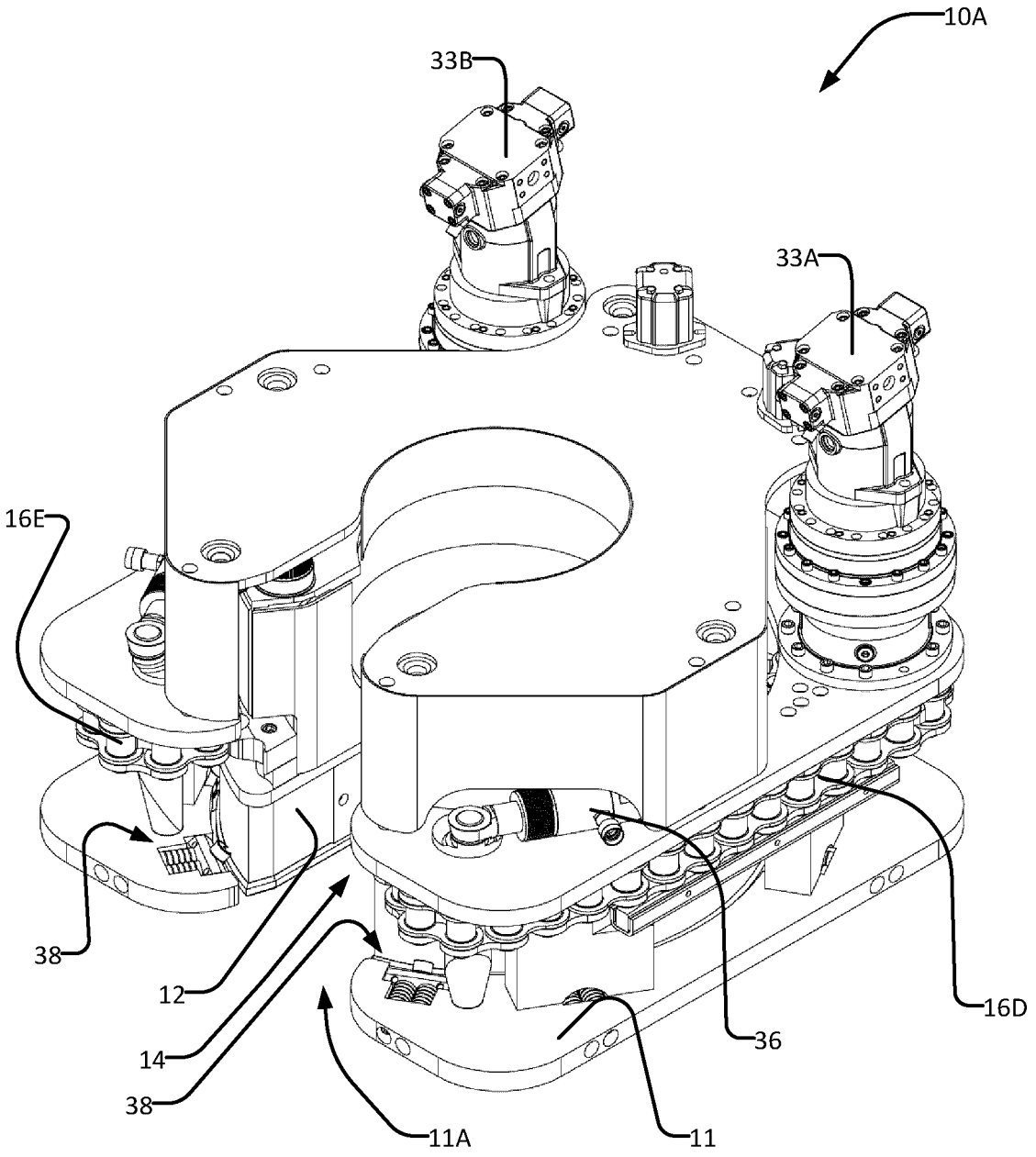
FIG. 7 is a perspective view of apparatus according to an alternative embodiment in which a rotor is driven by roller chains.

As mentioned above, flexible drive members 16 may take a variety of forms including link chains as illustrated for example in FIG. 1, roller chains, toothed chains and toothed belts. FIG. 7 illustrates apparatus 10A according to another example embodiment in which flexible drive members comprise roller chains 16D and 16E and rotor 12 has projecting sprocket teeth 18C (see FIG. 7B) which engage between rollers of roller chains 16D and 16E. In this embodiment, sprocket teeth 18C or the spaces between sprocket teeth 18C serve as driven features. In some embodiments roller chains 16D and 16E comprise sealed and bushed roller chains. Apparatus 10A may be otherwise similar to apparatus 10 of FIG. 1.

Figure 7A:
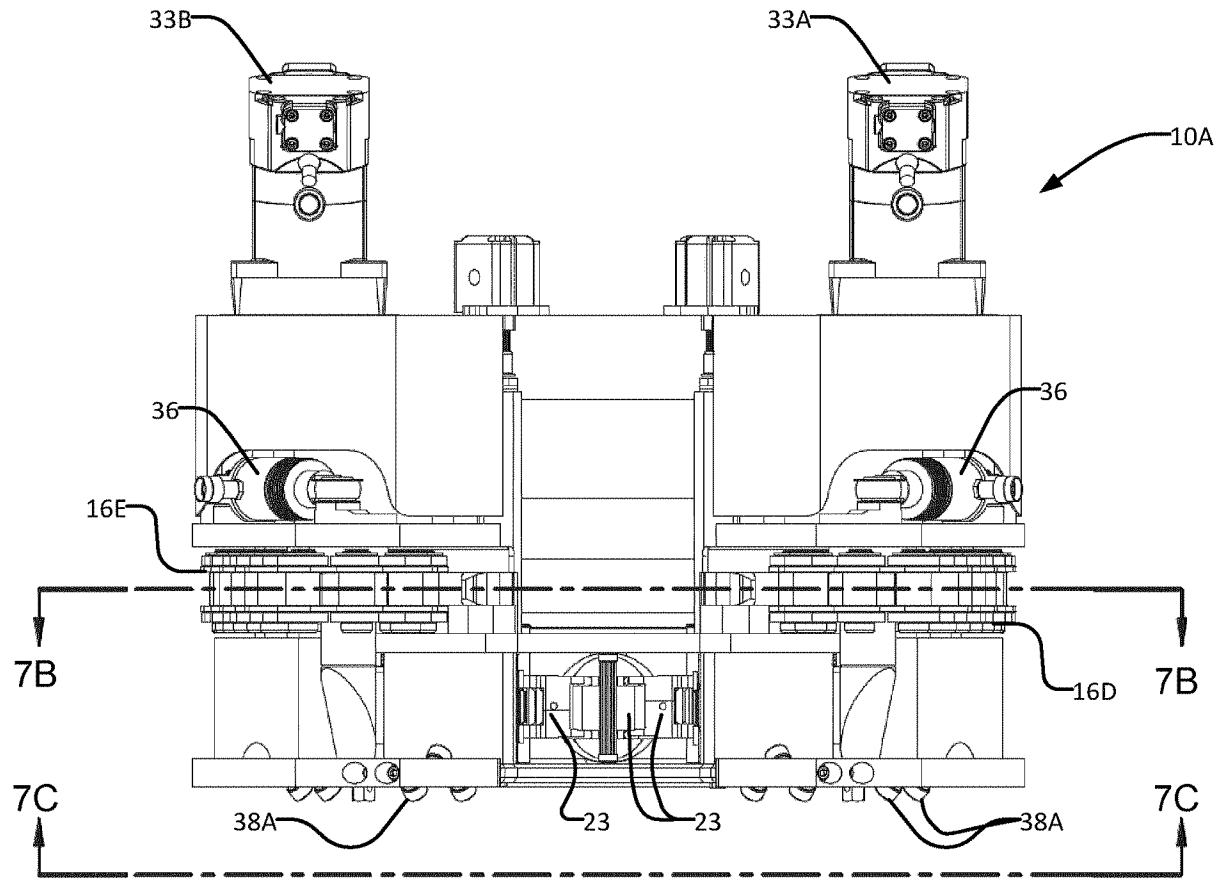
FIG. 7A is a front elevation view of the apparatus of FIG. 7.
Figure 7B:
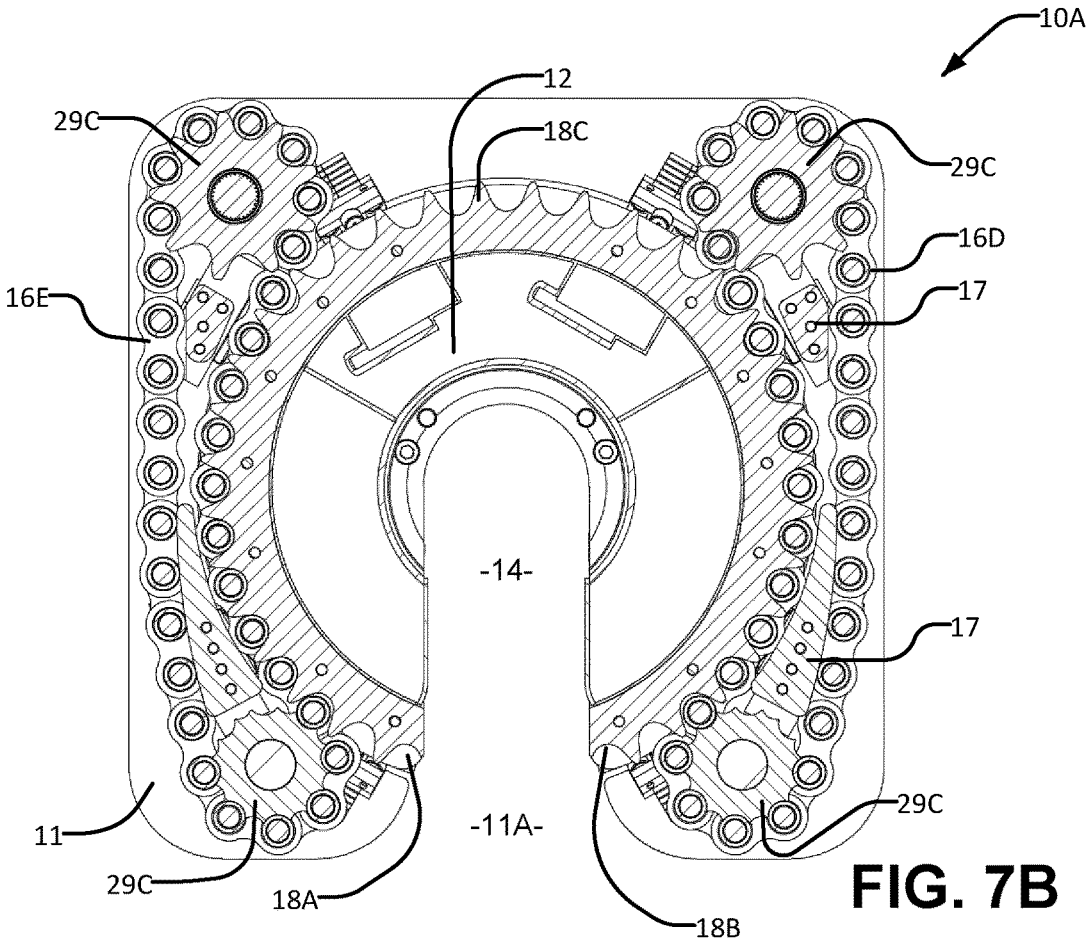
FIG. 7B is a cross section through the apparatus of FIG. 7A on the plane 7B-7B.
Figure 7C:
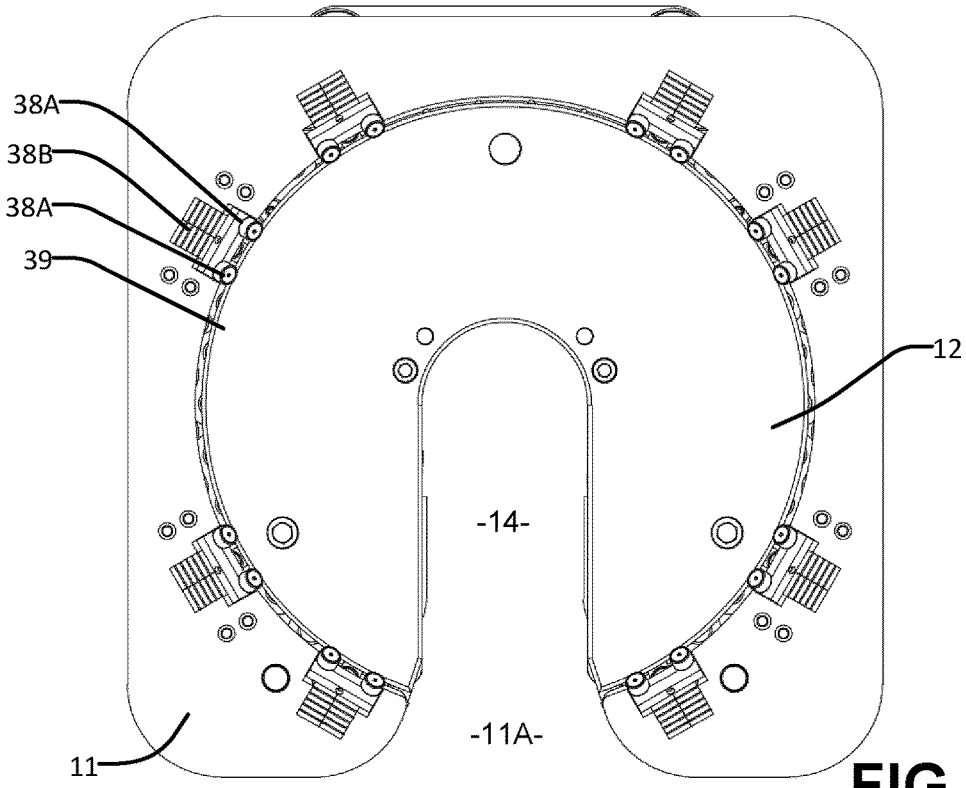
FIG. 7C is a bottom plan view of the apparatus of FIG. 7A.
Figure 7D:
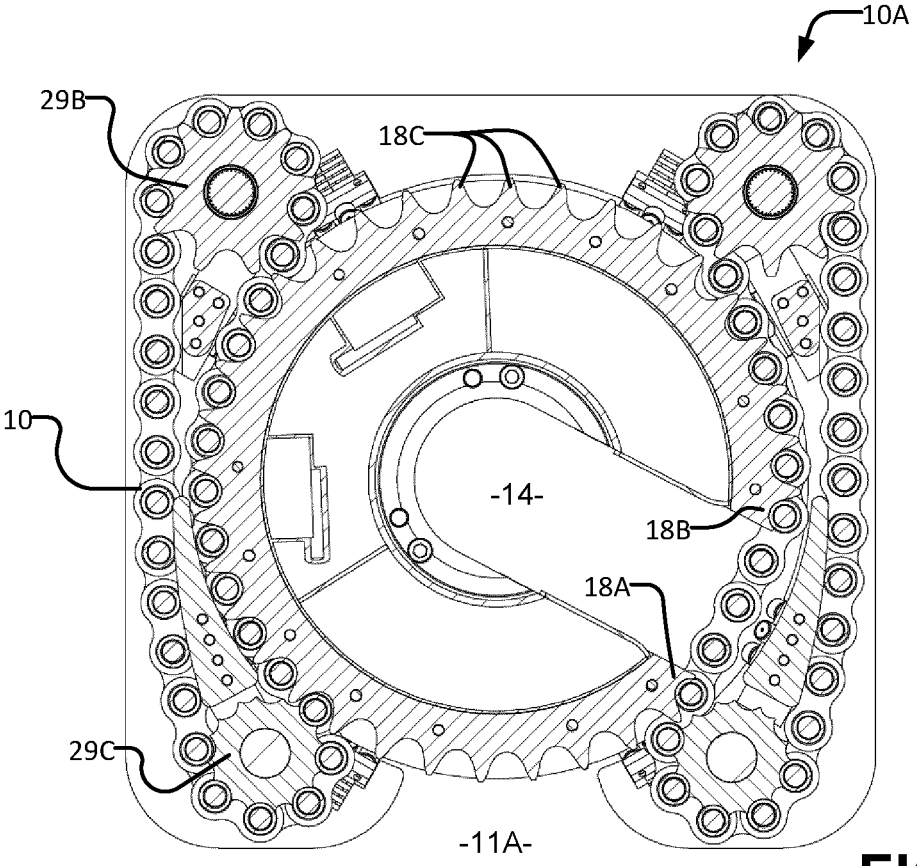
FIGS. 7D and 7E are respectively the views shown in FIGS. 7B and TC with the rotor at a different angle of rotation.
Figure 7E:
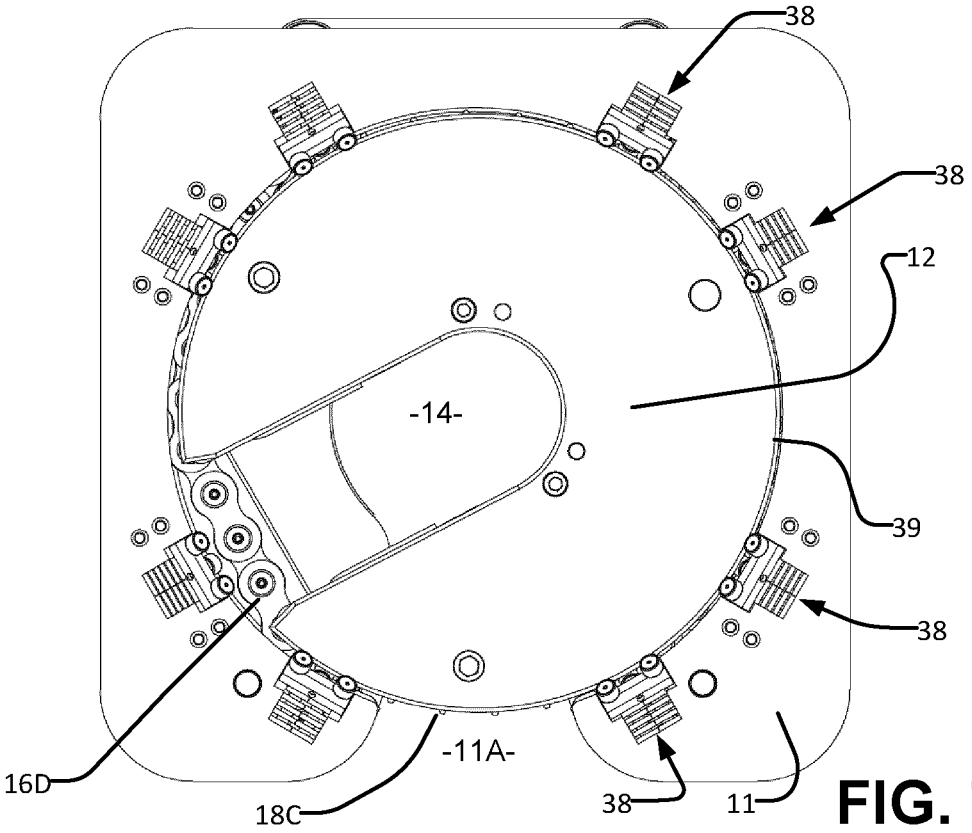

FIG. 7A is a front elevation view of apparatus 10A. FIG. 7B is a plan-view cross-section through apparatus 10A of FIG. 7 in a plane that cuts through roller chains 16D and 16E. FIG. 7C is a bottom plan view of apparatus 10A. FIGS. 7D and 7E are respectively the same views as FIGS. 7B and 7C with rotor 12 in a different orientation.

FIG. 7B shows driven features 18A and 18B on either side of gap 14. In this case, driven features 18A and 18B are spaces between sprocket teeth which receive rollers of roller chains 16D and 16E.

Figure 9A:
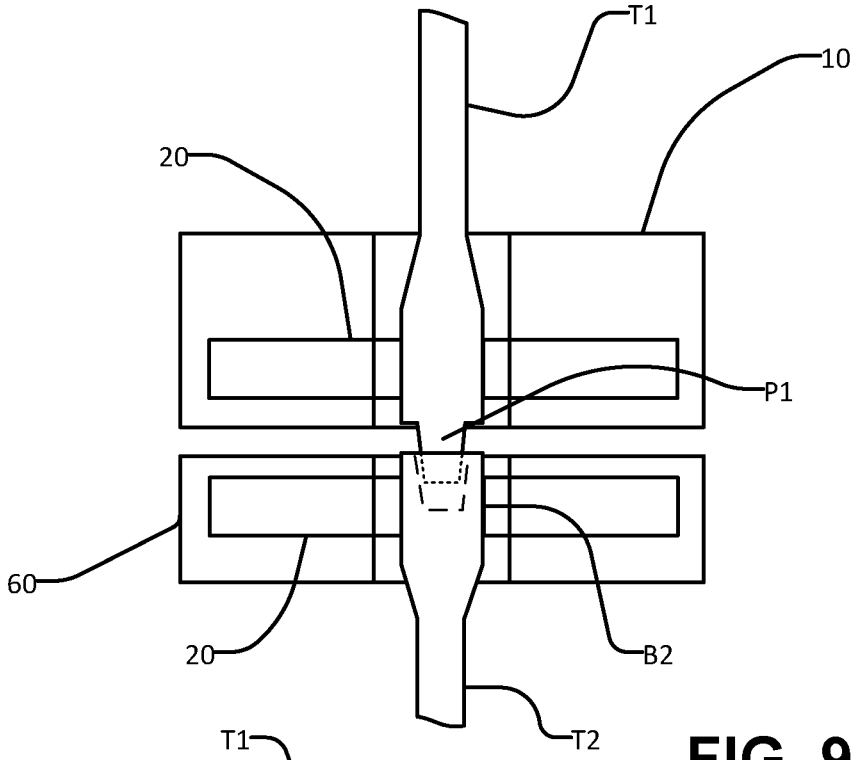
FIGS. 9A and 9B illustrate making up a connection between oilfield tubulars using apparatus as described herein.
Figure 9B:
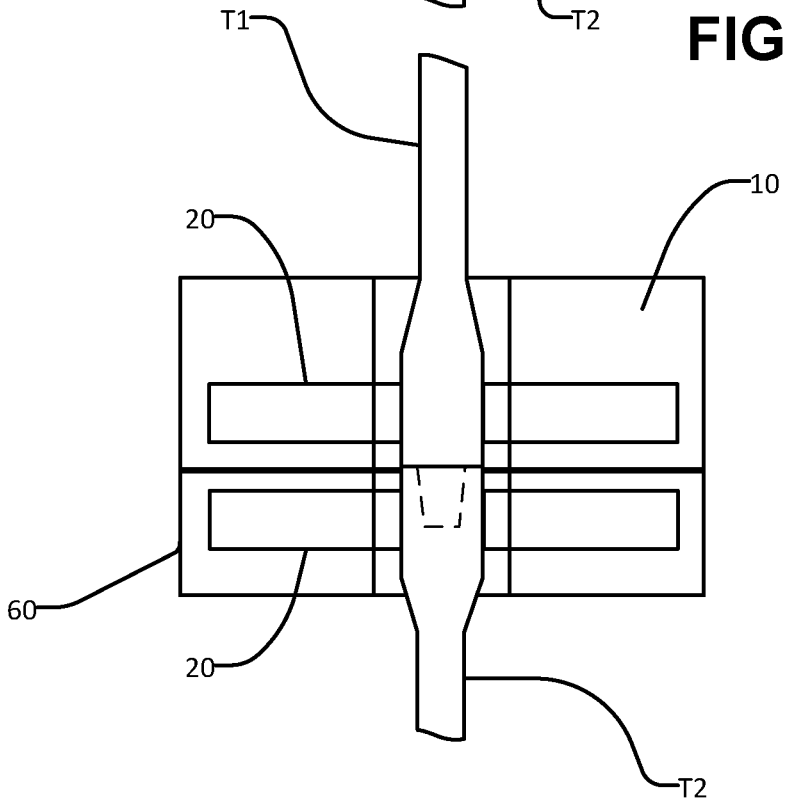

Apparatus as described herein has particular application in the oilfield for rotating oilfield tubulars such as drill pipe, casing and the like. FIGS. 9A and 9B illustrate the application of apparatus as described herein for making up a connection between two tubulars T1 and T2. In FIG. 9A the threaded pin end P1 of tubular T1 has been stabbed into the complementarily-threaded box end B2 of tubular T2. Tubular T1 is gripped by gripper 20 of apparatus 10 and tubular T2 is also gripped by a gripper of another apparatus 10 or a backup jaw (BUJ) for example. In the illustrated embodiment tubular T2 is gripped by the gripper 20 of a backup jaw 60.

Rotor 12 of apparatus 10 may then be rotated to make up the coupling between tubulars T1 and T2 as shown in FIG. 9B. The structure supporting apparatus 10 and backup jaw 60 permits relative motion between apparatus 10 and backup jaw 60 as a joint is made up (i.e. going from FIGS. 9*a* to 9*b*) or unmade (i.e. going from FIG. 9B to 9A. This motion may be allowed by providing suitable springs, actuators, linkages or the like, for example. Tubular T1 may be rotated relative to tubular T2 by several full rotations between the positions shown in FIGS. 9A and 9B. This rotation may be continuous. The rotation may be continued until the coupling has been made up to a desired torque value.

The apparatus may be applied in many cases where it is desirable to rotate an object. Some examples are:

- Apparatus as described herein may be applied in the field of forestry to handle logs. For example the apparatus may be used to grip and rotate a log for presentation to a saw or other mill machinery.
- Apparatus as described herein may be applied in the field of machining and manufacturing to engage elongated workpieces. The workpieces may approach the apparatus laterally (in contrast to typical bar feeders which feed bars axially into a chuck). For example, the apparatus may be applied as a chuck or rotating steady rest in a lathe.
- Apparatus as described herein may be applied in the field of pipeline construction and maintenance. For example, the apparatus could be applied to rotate a portion of a pipeline when there is no access to the end or it is favourable to approach laterally.
- Apparatus as described herein may be applied to a handling gripper of a loading arm on a loading arm rig (as used in the field of subsurface drilling for example). This can save time by permitting tubulars to be approached laterally as well as at the end.
- Apparatus as described herein may be applied as a powered wrench to rotate turnbuckles, guy wires, nuts, bolts and the like.
- Apparatus as described herein may be applied to rotate tubulars for drilling and/or to rotate casing.

In some embodiments a rotor 12 as described herein is mounted to a frame by a compliant mounting system that allows displacement of the center of the rotor 12 away from a neutral position. A drive system 15 for the rotor which comprises one or more tensioned flexible elements that wrap partially around and drivingly engage a periphery of the rotor (while leaving opening 11A unobstructed) may be operable to drive rotation of the rotor 12 despite such displacements A system for delivering power to rotor 12 for operations of on-board devices such as a gripper may also be compliant (e.g. by delivering power by way of a serpentine belt to sprockets carried by the rotor) so that such displacements of the rotor do not disrupt its operation. Such a construction facilitates subsurface well drilling for example for oil and gas exploration and recovery by allowing the rotor to be fully functional to continuously rotate a tubular such as a section of drill pipe or casing while delivering large torques without requiring exact alignment of frame 11 to the tubular.

Figure 7F:
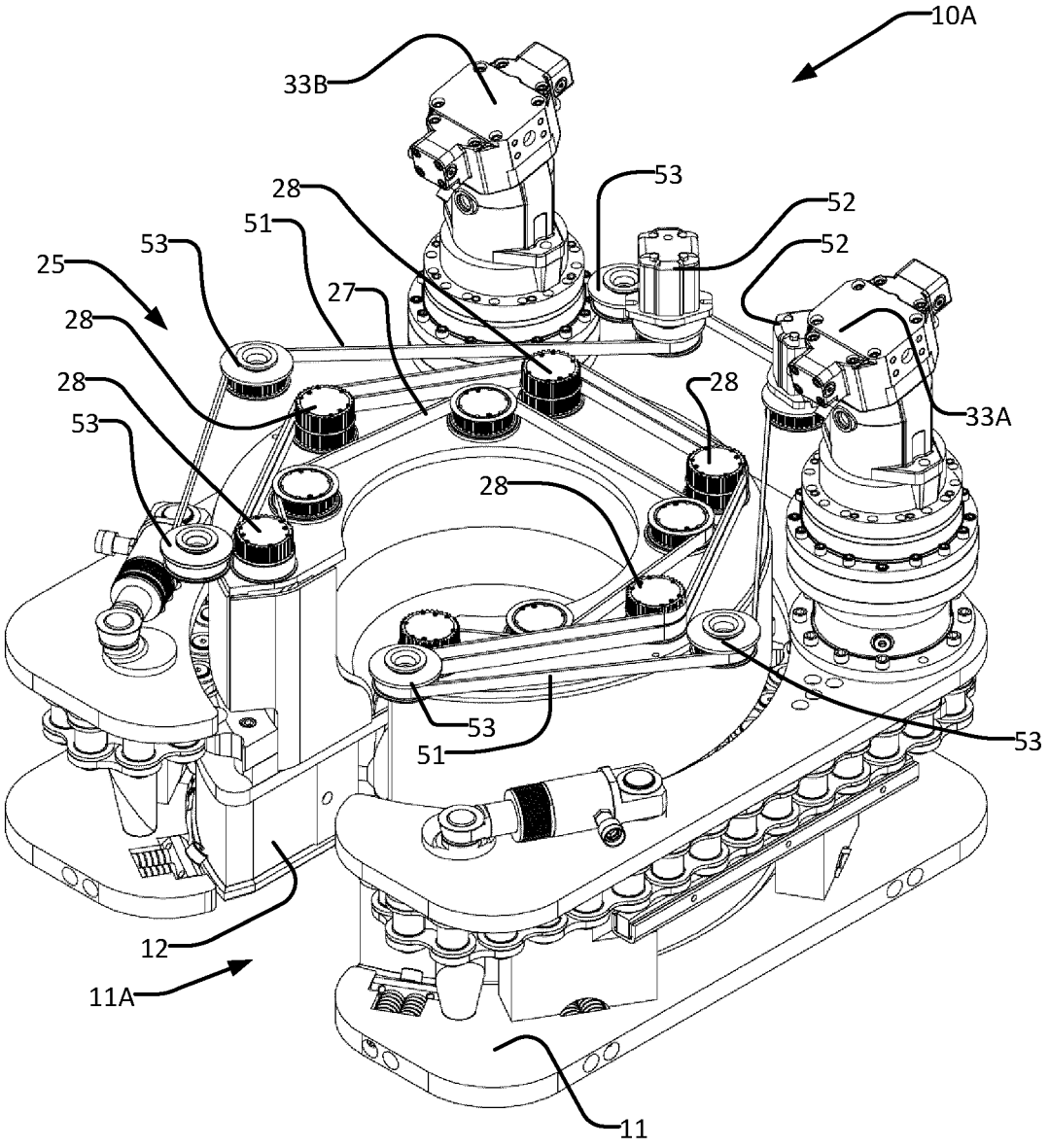
FIG. 7F shows details of an example power delivery mechanism that can supply power to a rotating rotor by way of serpentine belts.

FIG. 7F shows an example power delivery mechanism 25. Such a mechanism may optionally be provided in any embodiment. The power delivery mechanism provides a serpentine belt 51 driven by one or more motor(s) 52. Serpentine belt 51 forms a closed loop defined by idlers 53 that follows a path extending part way around rotor 12. An outer surface of serpentine belt 51 contacts rollers 28 which are carried by rotor 12. Rotation of rollers 28 drives one or more generators 26 carried by rotor 12. The path of serpentine belt 51 leaves unobstructed the area above opening 11A. Synchronization belt 27 keeps rollers 28 rotating at the same speed even when they are temporarily moved out of contact with serpentine belt 51. A tensioning mechanism accommodates changes in the path length of serpentine belt 51 that occur when rollers 28 move and/or as a result of radial displacements of rotor 12.

An advantage of apparatus as described herein is that rotor 12 may be driven with a torque that is substantially constant for all angular positions of rotor 12. For example, an apparatus as described herein may be constructed such that the delivered torque is constant to a few percent for all angular positions of rotor 12. If this small variation is a problem for any particular application then the variation may be further reduced, for example by tracking the angle of rotation of rotor 12 with a suitable encoder or other rotation/position sensor and controlling one or more motors driving rotor 12 based on the measured orientation angle of rotor 12. Such encoders may also be used to track the orientation of rotor 12 so that rotor 12 may be positioned with gap 14 facing in a desired direction (for example to receive or return a tubular or other elongated object). In some cases encoders are provided on drive shafts of one or more motors that drive circulation of drive members 16.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- "may" means optionally;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a motor, sprocket, roller, chain, assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. Apparatus useful for rotating a section of drill pipe, drill collar, drilling tool, casing or tubing, the apparatus comprising:

- a rotor mounted to a frame and supported for rotation by a compliant mounting, the rotor configured with a gap extending from a periphery of the rotor to a central region of the rotor;
- a gripping mechanism comprising one or more jaws carried by the rotor;

one or more grip actuators operable to move the jaws between an engaged configuration wherein the jaws grip an elongated object in the central region and a disengaged configuration wherein the jaws permit passage of the elongated object through the gap; and, a drive mechanism comprising a closed loop drive member having driving elements spaced apart along the drive member by a pitch distance; a portion of the drive member wrapped around a corresponding part of the periphery of a drive ring on the rotor, the drive ring including drive features configured to be engaged by the driving elements of the drive member and spaced apart from one another by the pitch distance on a portion of the drive ring extending from a first point on a first side of the gap to a second point on a second side of the gap, wherein the gap and drive ring are dimensioned such that the distance between the first point and the second point is an integer multiple of the pitch distance both when measured along a path taken by the drive member across the gap and along a path extending along the portion of the drive ring;

wherein the compliant mounting permits the rotor to rotate while a center of rotation of the rotor is located anywhere within a 12 mm diameter circle that is fixed relative to the frame;

wherein the drive mechanism comprises first and second rollers spaced apart from one another around a circumference of the rotor, the rollers positioned such that the drive member is flexed to provide a concave portion that contacts the rotor between the rollers; and wherein the drive mechanism comprises a tensioner comprising an actuator operable to tension the drive member.

2. Apparatus according to claim 1 wherein the actuator is coupled to move at least one of the first and second rollers.

3. Apparatus according to claim 2 comprising a cam operated by the actuator and configured to move one of the first and second rollers.

4. Apparatus according to claim 1 wherein the tensioner comprises a spring.

5. Apparatus according to claim 4 wherein the actuator is connected to operate in parallel with the spring.

6. Apparatus according to claim 1 wherein the actuator is operable to accommodate changes in a path length of the drive member occurring as a result of one or both of rotation of the rotor and transverse displacements of the rotor relative to an axis of the rotor.

7. Apparatus according to claim 1 wherein the tensioner comprises a hydraulic actuator connected to a source of pressurized fluid.

8. Apparatus according to claim 7 wherein the source of pressurized fluid has a variable pressure that increases with increased torque on the rotor.

9. Apparatus according to claim 7 wherein the source of pressurized fluid has a variable pressure that depends on a direction of circulation of the drive member.

10. Apparatus according to claim 7 wherein the source of pressurized fluid comprises an input line to a hydraulic motor driving the drive member.

11. Apparatus according to claim 1 comprising plural drive mechanisms.

12. Apparatus according to claim 11 wherein the plural drive mechanisms are spaced around the rotor and arranged such that radial forces exerted on the rotor by each of the drive mechanisms substantially cancel out.

13. Apparatus according to claim 11 wherein the plural drive mechanisms comprise two drive mechanisms opposed to one another such that radial forces exerted on the rotor by each of the two drive mechanisms oppose one another.

14. Apparatus according to claim 1 wherein the rotor is supported by a plurality of spring-loaded rollers or slides spaced apart around a periphery of the rotor.

15. Apparatus according to claim 14 wherein the spring-loaded rollers engage a flange carried by the rotor and thereby provide axial support to the rotor.

16. Apparatus according to claim 15 wherein the flange comprises ramped portions at either side of the gap.

17. Apparatus according to claim 1 further comprising an umbilical connected to deliver power to the rotor.

18. Apparatus according to claim 17 wherein the umbilical is stored on a spring-loaded reel.

19. Apparatus according to claim 1 wherein the drive member comprises a chain.

20. Apparatus according to claim 19 wherein the drive member comprises a roller chain.

21. Apparatus according to claim 19 wherein the drive member comprises a link chain comprising a plurality of links that each form at least one loop, each of the links passing through the loops of adjacent links to either side.

22. Apparatus according to claim 21 wherein the chain comprises first links that are parallel to a transverse plane of the rotor alternating with second links that are perpendicular to the first links.

23. Apparatus according to claim 1 wherein the drive member comprises a toothed belt.

24. Apparatus according to claim 23 wherein inner and outer faces of the belt are toothed.

25. Apparatus useful for rotating a section of drill pipe, drill collar, drilling tool, casing or tubing, the apparatus comprising:

a rotor mounted to a frame and supported for rotation by a compliant mounting, the rotor configured with a gap extending from a periphery of the rotor to a central region of the rotor;

a gripping mechanism comprising one or more jaws carried by the rotor;

one or more grip actuators operable to move the jaws between an engaged configuration wherein the jaws grip an elongated object in the central region and a disengaged configuration wherein the jaws permit passage of the elongated object through the gap;

one or more generators carried by the rotor and a serpentine belt arranged to follow a path having a portion wherein the serpentine belt engages sprockets carried on the rotor and located outside of a loop made by the path of the serpentine belt, the sprockets connected to drive the one or more generators; and a drive mechanism comprising a closed loop drive member having driving elements spaced apart along the drive member by a pitch distance; a portion of the drive member wrapped around a corresponding part of the periphery of a drive ring on the rotor, the drive ring including drive features configured to be engaged by the driving elements of the drive member and spaced apart from one another by the pitch distance on a portion of the drive ring extending from a first point on a first side of the gap to a second point on a second side of the gap, wherein the gap and drive ring are dimensioned such that the distance between the first point and the second point is an integer multiple of the pitch distance both when measured along a path taken by the drive member across the gap and along a path extending along the portion of the drive ring;

wherein the compliant mounting permits the rotor to rotate while a center of rotation of the rotor is located anywhere within a 12 mm diameter circle that is fixed relative to the frame.

26. Apparatus useful for rotating oilfield tubulars, the apparatus comprising:

a rotor mounted to a frame configured with an opening on at least one side of the rotor, the rotor comprising a gap extending from a periphery of the rotor to a central region of the rotor through which a central axis of the rotor passes the rotor mounted to the frame by way of a compliant mounting that permits rotation of the rotor relative to the frame and displacements of the rotor relative to the frame that are radial relative to the central axis of the rotor, the compliant mounting comprising resiliently biased sliders or rollers;

a gripper on the rotor, the gripper arranged to grip a tubular located on or close to the central axis;

a compliant drive mechanism comprising a closed loop drive member arranged to circulate around a first path wherein the rotor is on an outside of the first path and a portion of the drive member is wrapped around a corresponding part of the periphery of the rotor, a motor connected to drive the drive member and a tensioner comprising an actuator connected to tension the drive member.

27. Apparatus according to claim 26 comprising a system for delivering power to the rotor, the system comprising a closed loop serpentine member arranged to circulate around a second closed path wherein the rotor is outside of the second closed path, an outside of the serpentine member engages plural sprockets carried by the rotor and the serpentine member comprises a tensioner arranged to tension the serpentine member sufficiently to maintain contact of the serpentine member with one or more of the sprockets while accommodating the radial displacements of the rotor within a range permitted by the compliant mounting.

28. Apparatus according to claim 26 wherein the drive member has driving elements spaced apart along the drive member by a pitch distance; the rotor includes drive features configured to be engaged by the driving elements of the drive member and spaced apart from one another by the pitch distance on a portion of a drive ring extending from a first point on a first side of the gap to a second point on a second side of the gap, wherein the gap and drive ring are dimensioned such that the distance between the first point and the second point is an integer multiple of the pitch distance both when measured along a path taken by the drive member across the gap and along a path extending along the portion of the drive ring.

29. Apparatus according to claim 26 wherein the drive mechanism comprises first and second rollers spaced apart from one another around a circumference of the rotor, the rollers positioned such that the drive member is flexed to provide a concave portion that contacts the rotor between the rollers.

30. Apparatus according to claim 29 wherein the actuator is coupled to move at least one of the first and second rollers.

31. Apparatus according to claim 30 comprising a cam operated by the actuator and configured to move one of the first and second rollers.

32. Apparatus according to claim 26 wherein the tensioner comprises a spring.

33. Apparatus according to claim 32 wherein the actuator is connected to operate in parallel with the spring.

34. Apparatus according to claim 26 wherein the tensioner comprises a hydraulic actuator connected to a source of pressurized fluid.

35. Apparatus according to claim 34 wherein the source of pressurized fluid has a variable pressure that increases with increased torque on the rotor.

36. Apparatus according to claim 34 wherein the source of pressurized fluid has a variable pressure that depends on a direction of circulation of the drive member.

37. Apparatus according to claim 34 wherein the motor is a hydraulic motor and the source of pressurized fluid comprises an input line to the hydraulic motor.

38. Apparatus according to claim 26 comprising plural drive mechanisms.

39. Apparatus according to claim 38 wherein the plural drive mechanisms are spaced around the rotor and arranged such that radial forces exerted on the rotor by each of the drive mechanisms substantially cancel out.

40. Apparatus according to claim 38 wherein the plural drive mechanisms comprise two drive mechanisms opposed to one another such that radial forces exerted on the rotor by each of the two drive mechanisms oppose one another.

41. Apparatus according to claim 26 wherein the compliant mounting permits the rotor to rotate while the central axis of the rotor is located anywhere within a 12 mm diameter circle that is fixed relative to the frame.

42. Apparatus according to claim 26 wherein the compliant mounting provides axial support to the rotor.

43. Apparatus according to claim 42 wherein the resiliently-mounted sliders or rollers engage a flange carried by the rotor.

44. Apparatus according to claim 43 wherein the flange comprises ramped portions at either side of the gap.

45. Apparatus according to claim 26 wherein the drive member comprises a chain.

46. Apparatus according to claim 45 wherein the drive member comprises a roller chain.

47. Apparatus according to claim 45 wherein the drive member comprises a link chain comprising a plurality of links that each form at least one loop, each of the links passing through the loops of adjacent links to either side.

48. Apparatus according to claim 47 wherein the chain comprises first links that are parallel to a transverse plane of the rotor alternating with second links that are perpendicular to the first links.

49. Apparatus according to claim 26 wherein the drive member comprises a toothed belt.

50. Apparatus according to claim 49 wherein inner and outer faces of the belt are toothed.

* * * * *